US011479428B2

(12) United States Patent
Ishido

(10) Patent No.: US 11,479,428 B2
(45) Date of Patent: Oct. 25, 2022

(54) IMAGE FORMING DEVICE

(71) Applicant: KYOCERA Document Solutions Inc., Osaka (JP)

(72) Inventor: Kohei Ishido, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 154 days.

(21) Appl. No.: 17/109,249

(22) Filed: Dec. 2, 2020

(65) Prior Publication Data

US 2021/0171304 A1 Jun. 10, 2021

(30) Foreign Application Priority Data

Dec. 6, 2019 (JP) ..... JP2019-221152

(51) Int. Cl.
*B65H 9/00* (2006.01)
*B65H 7/08* (2006.01)
*B65H 7/20* (2006.01)

(52) U.S. Cl.
CPC ..... *B65H 9/002* (2013.01); *B65H 7/08* (2013.01); *B65H 7/20* (2013.01); *B65H 2301/331* (2013.01); *B65H 2404/14212* (2013.01); *B65H 2513/106* (2013.01); *B65H 2553/416* (2013.01)

(58) Field of Classification Search
CPC ... B65H 7/06; B65H 7/08; B65H 7/14; B65H 7/20; B65H 9/002; B65H 9/10; B65H 2301/331; B65H 2402/31; B65H 2404/142; B65H 2404/14212; B65H 2513/104; B65H 2513/106; B65H 2513/50; B65H 2553/416; B65H 2553/45
See application file for complete search history.

(56) References Cited

U.S. PATENT DOCUMENTS

2006/0285903 A1* 12/2006 Yamane ..... B65H 9/16 399/394
2012/0262513 A1* 10/2012 Mandel ..... B65H 7/02 347/16
2019/0161299 A1* 5/2019 Egawa ..... B65H 7/14

FOREIGN PATENT DOCUMENTS

JP 2019-082542 5/2019

* cited by examiner

*Primary Examiner* — Prasad V Gokhale
(74) *Attorney, Agent, or Firm* — Lex IP Meister, PLLC

(57) ABSTRACT

An image forming device includes an image forming unit, a reading unit, a registration-less unit, and an engine control unit. The reading unit reads a sheet to be conveyed. The engine control unit moves the other end side of the registration-less unit to correct skew. The engine control unit obtains a deviation amount (first deviation amount) of the position of the sheet based on the correction, and changes a sheet conveyance speed from a first speed to a second speed when the sheet enters the registration-less unit. The engine control unit adjusts the timing to change from the first speed to the second speed based on the first deviation amount.

8 Claims, 19 Drawing Sheets

IMAGE FORMING DEVICE

INCORPORATION BY REFERENCE

This application is based upon, and claims the benefit of priority from, corresponding Japanese Patent Application No. 2019-221152 filed in the Japan Patent Office on Dec. 6, 2019, the entire contents of which are incorporated herein by reference.

BACKGROUND

Field of the Invention

The present disclosure relates to an image forming device that conveys a sheet and reads a sheet to be conveyed.

Description of Related Art

Typically, an image forming device, such as a multifunction peripheral or a printer, includes a registration roller. A pair of registration rollers is used to correct the skew of a sheet. When a sheet arrives, the pair of registration rollers is stopped, and the downstream end portion of the sheet is abutted to the pair of registration rollers. A pair of conveyance rollers on the upstream side of the pair of registration rollers continues to feed the sheet. This causes the sheet to warp. Due to the elasticity of the sheet, the downstream end portion of the sheet is aligned with the nip of the pair of registration rollers. This allows to correct the skew of the sheet. It may be preferable not to perform the skew correction by the pair of registration rollers, depending on the type of the sheet.

SUMMARY

An image forming device according to the present disclosure includes an image forming unit, a reading unit, a registration-less unit, and an engine control unit. The image forming unit forms an image on a sheet to be conveyed. The reading unit is provided on the upstream side of the image forming unit in a sheet conveyance direction. The reading unit includes a line sensor arranged so that pixels are arranged in a main scanning direction. The reading unit reads the sheet to be conveyed. The registration-less unit is provided on the upstream side of the image forming unit in the sheet conveyance direction and on the downstream side of the reading unit in the sheet conveyance direction. The engine control unit recognizes that the sheet has reached the line sensor, and an inclination angle of the sheet to be conveyed, based on an analog image signal output by the line sensor. The engine control unit controls a sheet conveyance speed. The registration-less unit includes a pair of registration-less rollers, a registration-less motor, a case, and a moving mechanism. The pair of registration-less rollers feeds the sheet toward the image forming unit. The registration-less motor rotates the pair of registration-less rollers. The case accommodates the pair of registration-less rollers and has a fulcrum provided on one end side in the main scanning direction. The moving mechanism moves the other end side of the case in the sheet conveyance direction around the fulcrum. When the sheet enters the nip of the pair of registration-less rollers, the engine control unit moves the other end side of the case to the moving mechanism to correct the skew of the sheet. The engine control unit obtains a first deviation amount that is a deviation amount of the position of the sheet based on the correction. The engine control unit rotates the pair of registration-less rollers such that the sheet conveyance speed becomes a first speed at a time when the downstream end side of the sheet in the sheet conveyance direction reaches the registration-less unit. The engine control unit rotates the pair of registration-less rollers such that the sheet conveyance speed becomes a second speed after the sheet enters the nip of the pair of registration-less rollers. The engine control unit adjusts the timing of changing from the first speed to the second speed based on the first deviation amount.

DETAILED DESCRIPTION

Hereinafter, an image forming device according to an embodiment will be described with reference to FIGS. 1 to 20. As the image forming device, a multifunction peripheral 100 will be described as an example. The multifunction peripheral 100 can print and transmit based on image data.

Note that the present disclosure can also be applied to an image forming device other than the multifunction peripheral 100, such as a printer. Each element such as the configuration and arrangement described in the description of the present embodiment does not limit the scope of the present disclosure, and is merely an illustrative examples.

(Multifunction Peripheral 100)

Figure 1:
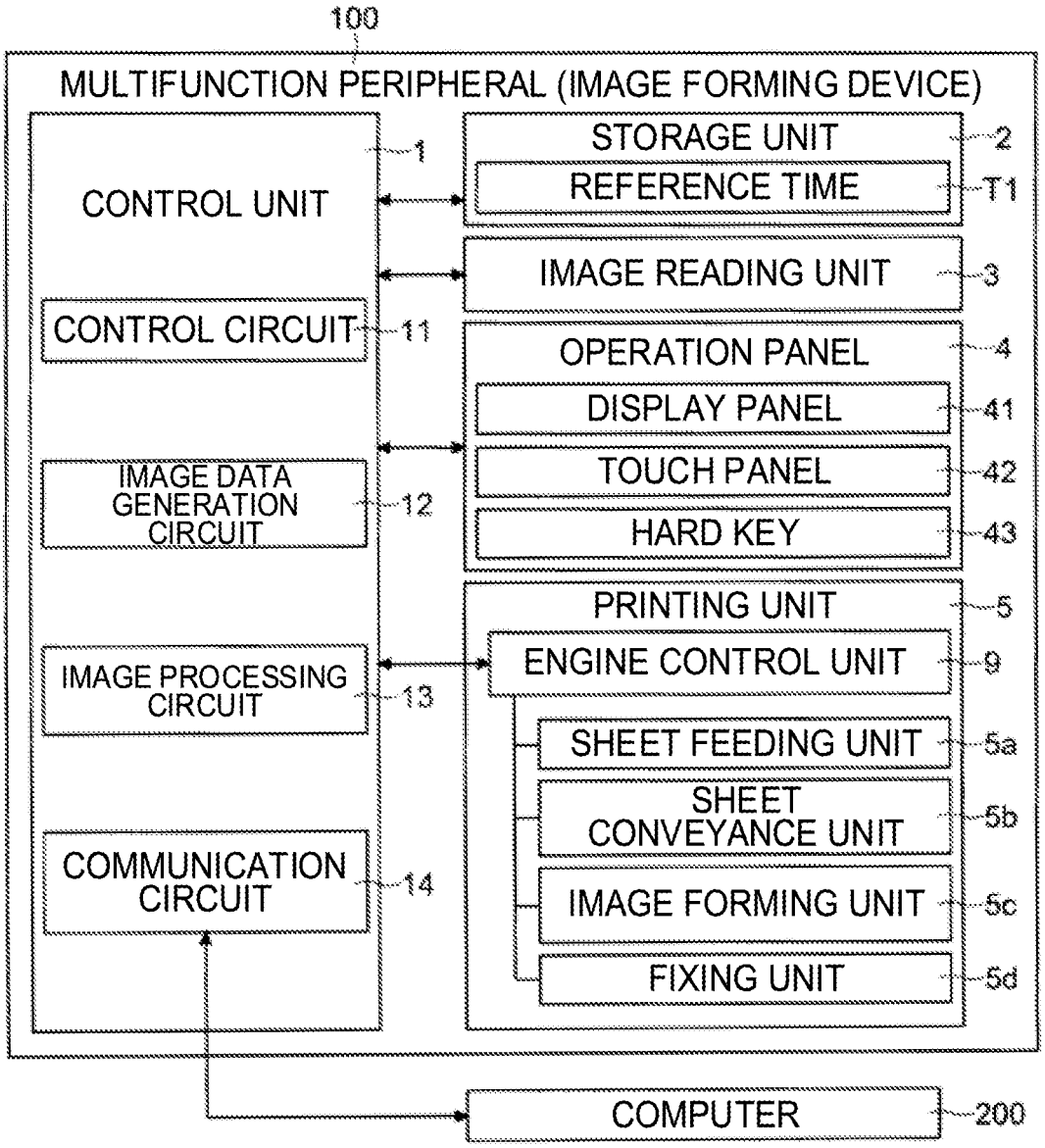
FIG. 1 is a diagram illustrating an example of a multifunction peripheral according to an embodiment.
Figure 2:
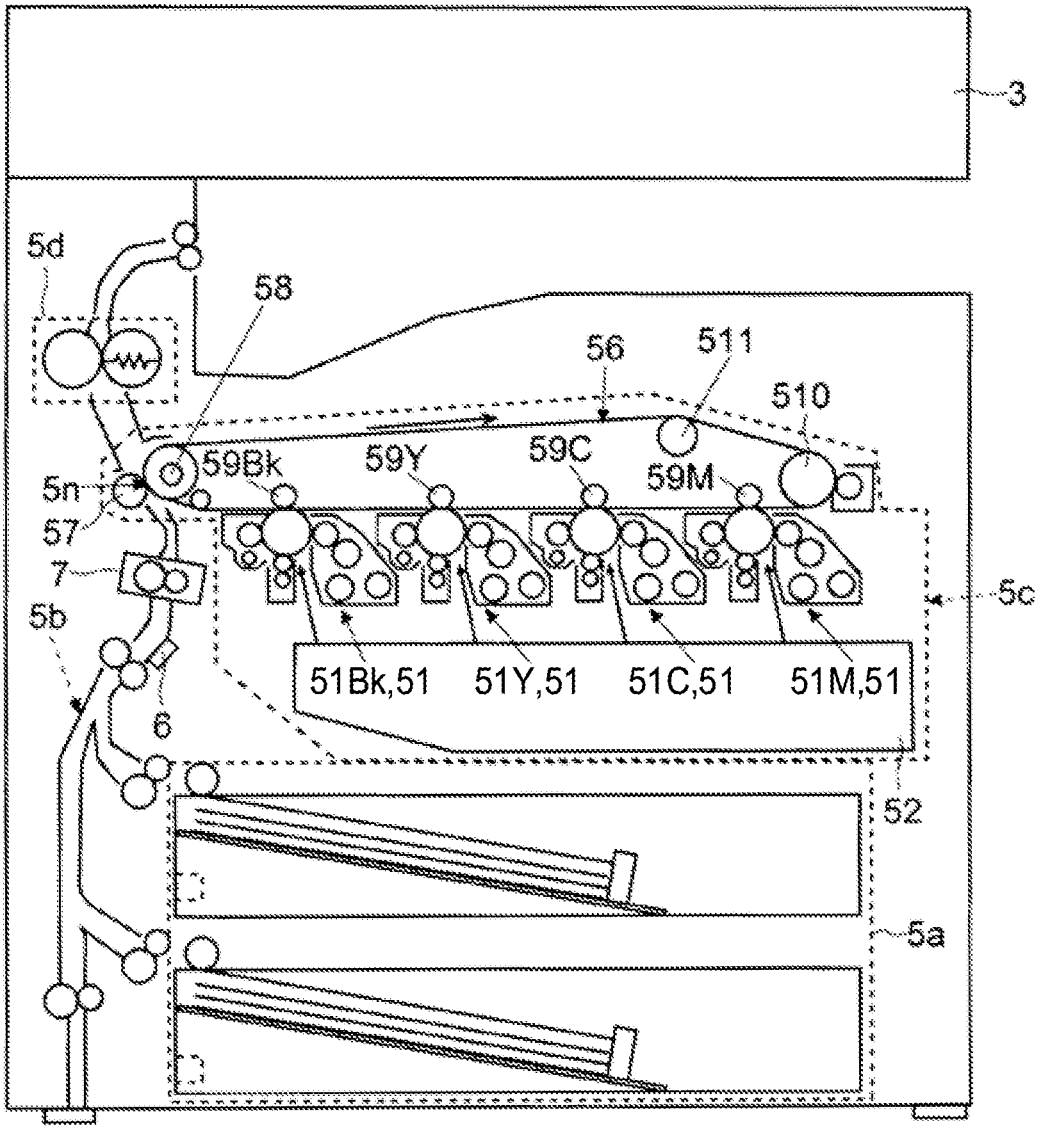
FIG. 2 is a diagram illustrating an example of the multifunction peripheral according to the embodiment.
Figure 3:
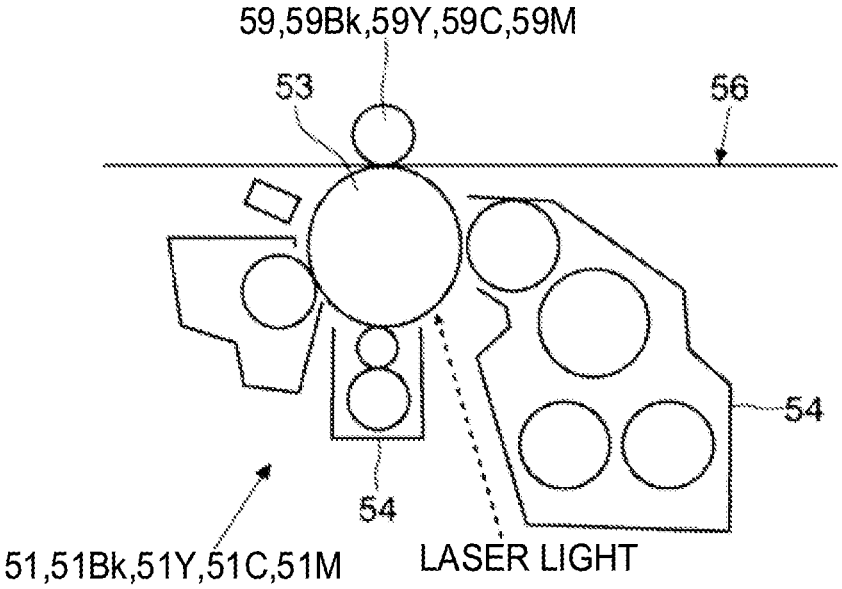
FIG. 3 is a diagram illustrating an example of an image forming unit according to the embodiment.

The multifunction peripheral 100 according to the embodiment will be described with reference to FIGS. 1 to 3. FIGS. 1 and 2 are diagrams illustrating an example of the multifunction peripheral 100 according to the embodiment. FIG. 3 is a diagram illustrating an example of an image forming unit 5*c* according to the embodiment.

As illustrated in FIG. 1, the multifunction peripheral 100 includes a control unit 1, a storage unit 2, an image reading unit 3, an operation panel 4, and a printing unit 5.

The control unit 1 controls the operation of each unit in a job such as printing or transmission. The control unit 1 includes a control circuit 11, an image data generation circuit 12, an image processing circuit 13, and a communication circuit 14. For example, the control circuit 11 is a central processing unit (CPU). The control circuit 11 performs processing and calculation relating to the job. For example, the image data generation circuit 12 includes an analog/digital (A/D) conversion circuit. The image data generation circuit 12 processes an analog image signal output by the image reading unit 3 based on the reading of a document in order to generate image data of the document. The image processing circuit 13 is an integrated circuit for image processing (for example, an application specific integrated circuit (ASIC)). The image processing circuit 13 performs image processing of image data of a document.

The communication circuit 14 includes a communication control circuit and a communication memory. The communication control circuit controls the communication. The communication memory stores a software for the communication. The communication circuit 14 communicates with a computer 200. For example, the computer 200 is a personal computer (PC) or a server. The communication circuit 14 receives print data from the computer 200. The control unit 1 causes the printing unit 5 to perform printing (print job) based on the received print data. Further, the control unit 1 causes the communication circuit 14 to transmit image data toward the destination set on the operation panel 4 (transmission job).

The storage unit 2 includes a random access memory (RAM), a read only memory (ROM), and a storage. For example, the storage is a hard disk drive (HDD) or a solid state drive (SSD). The control unit 1 controls each unit based on a program and data in the storage unit 2. The image reading unit 3 includes a light source and an image sensor. The image reading unit 3 reads a document.

The operation panel 4 receives a setting input by a user. The operation panel 4 includes a display panel 41, a touch panel 42, and a hard key 43. The control unit 1 causes the display panel 41 to display a message and a screen for setting. The control unit 1 causes the display panel 41 to display an image for operation. For example, the image for operation may be a button, a key, or a tab. The control unit 1 recognizes the operated image for operation, based on the output from the touch panel 42. The hard key 43 includes a start key and a numeric keypad. The touch panel 42 and the hard key 43 receive a setting operation (an operation related to a job) input by a user. The control unit 1 recognizes the set content based on the output from the operation panel 4.

The printing unit 5 includes an engine control unit 9, a sheet feeding unit 5*a*, a sheet conveyance unit 5*b*, an image forming unit 5*c*, and a fixing unit 5*d*. The engine control unit 9 includes an engine control circuit 91 (engine CPU), a unit control circuit 92, and an engine memory 93 (see FIG. 7). The engine memory 93 stores a program and data for print control. The engine control unit 9 controls the operations of the sheet feeding unit 5*a*, the sheet conveyance unit 5*b*, the image forming unit 5*c*, and the fixing unit 5*d*, based on a print instruction from the control unit 1. The engine control circuit 91 and the unit control circuit 92 perform control, based on the program and data in the engine memory 93. The engine control circuit 91 controls a sheet conveyance speed.

The sheet feeding unit 5*a* includes a sheet cassette for accommodating a sheet and a sheet feeding roller for feeding a sheet. At the time of printing, the engine control circuit 91 causes the sheet feeding unit 5*a* to feed a sheet. The sheet conveyance unit 5*b* includes a motor and a pair of conveyance rollers. The engine control circuit 91 causes the sheet conveyance unit 5*b* to convey the sheet fed from the sheet feeding unit 5*a*. The sheet conveyance unit 5*b* conveys a sheet in the image forming device.

The image forming unit 5*c* forms an image (toner image). As illustrated in FIGS. 2 and 3, the image forming unit 5*c* includes an image forming unit 51 for four colors, an exposure device 52, and an intermediate transfer unit. The multifunction peripheral 100 includes an image forming unit 51Bk that forms a black image, an image forming unit 51Y that forms a yellow image, an image forming unit 51C that forms a cyan image, and an image forming unit 51M that forms a magenta image. Although the colors of the toner images to be formed are different, each configuration of the image forming units 51Bk to 51M is basically the same. In the following description, the reference numerals Bk, Y, C, M of each image forming unit 51 will be omitted unless otherwise specified.

Each of the image forming units 51 includes a photosensitive drum 53, a charging device 54, and a developing device 55. At the time of printing, the engine control circuit 91 rotates a drum motor (not illustrated) to rotate the photosensitive drum 53. Further, the engine control circuit 91 charges the photosensitive drum 53 to the charging device 54. Further, the engine control circuit 91 exposes the photosensitive drum 53 to the exposure device 52 based on image data. The developing device 55 accommodates a developing agent containing toner. The engine control unit 9 causes the developing device 55 to develop an electrostatic latent image on the photosensitive drum 53 with toner.

The intermediate transfer unit includes an intermediate transfer belt 56, a secondary transfer roller 57, a drive roller 58, primary transfer rollers 59Bk, 59Y, 59C and 59M, and driven rollers 510 and 511. The axial directions of each of the rollers are parallel to one another. The intermediate transfer belt 56 has an endless shape. The intermediate transfer belt 56 is wound around each of the rollers. The intermediate transfer belt 56 receives the primary transfer of a toner image from the photosensitive drum 53. Further, the secondary transfer roller 57 secondarily transfers the toner image onto a sheet. The nip between the secondary transfer roller 57 and the intermediate transfer belt 56 (secondary transfer nip 5*n*) is the position where an image is placed on a sheet.

The fixing unit 5*d* includes a heater and a fixing roller. The engine control unit 9 causes the fixing roller to heat and pressurize a sheet on which a toner image is transferred. The engine control unit 9 causes the fixing unit 5*d* to fix the toner image. The sheet conveyance unit 5*b* discharges the fixed sheet to the outside of the image forming device (discharge tray).

(Reading Unit 6 and Registration-Less Unit 7)

Figure 4:
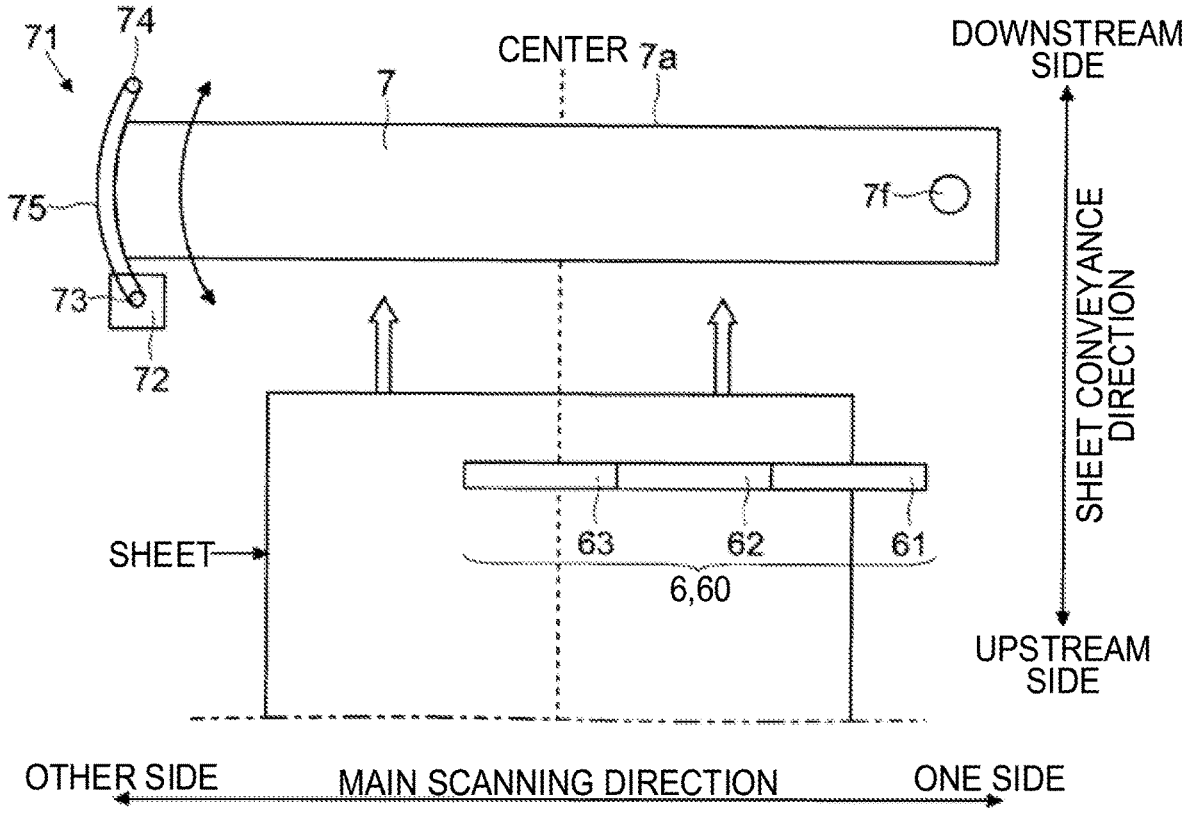
FIG. 4 is a diagram illustrating an example of a reading unit and a registration-less unit according to the embodiment.
Figure 5:
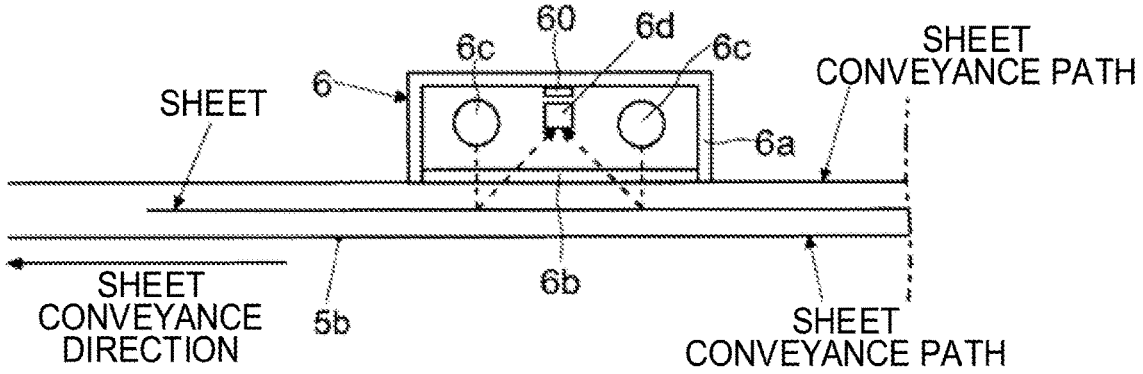
FIG. 5 is a diagram illustrating an example of the reading unit according to the embodiment.
Figure 6:
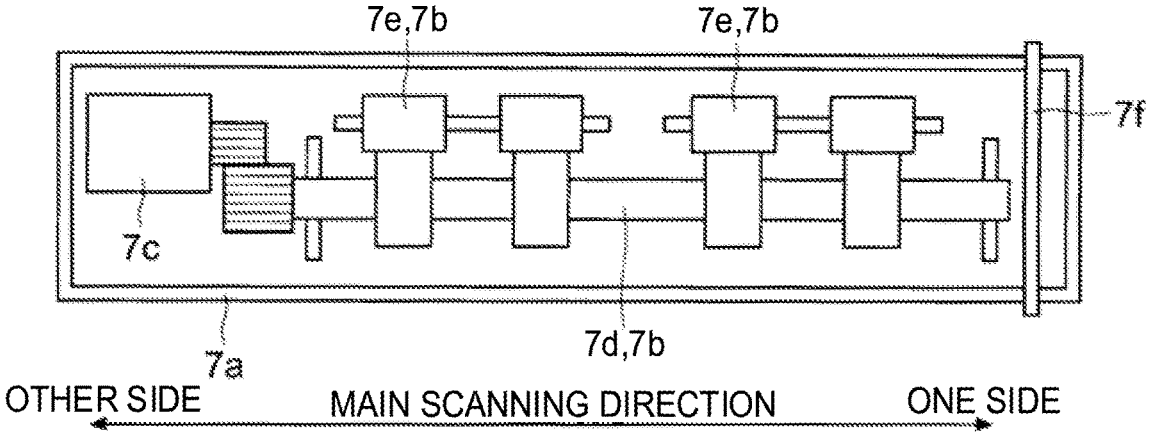
FIG. 6 is a diagram illustrating an example of the registration-less unit according to the embodiment.
Figure 7:
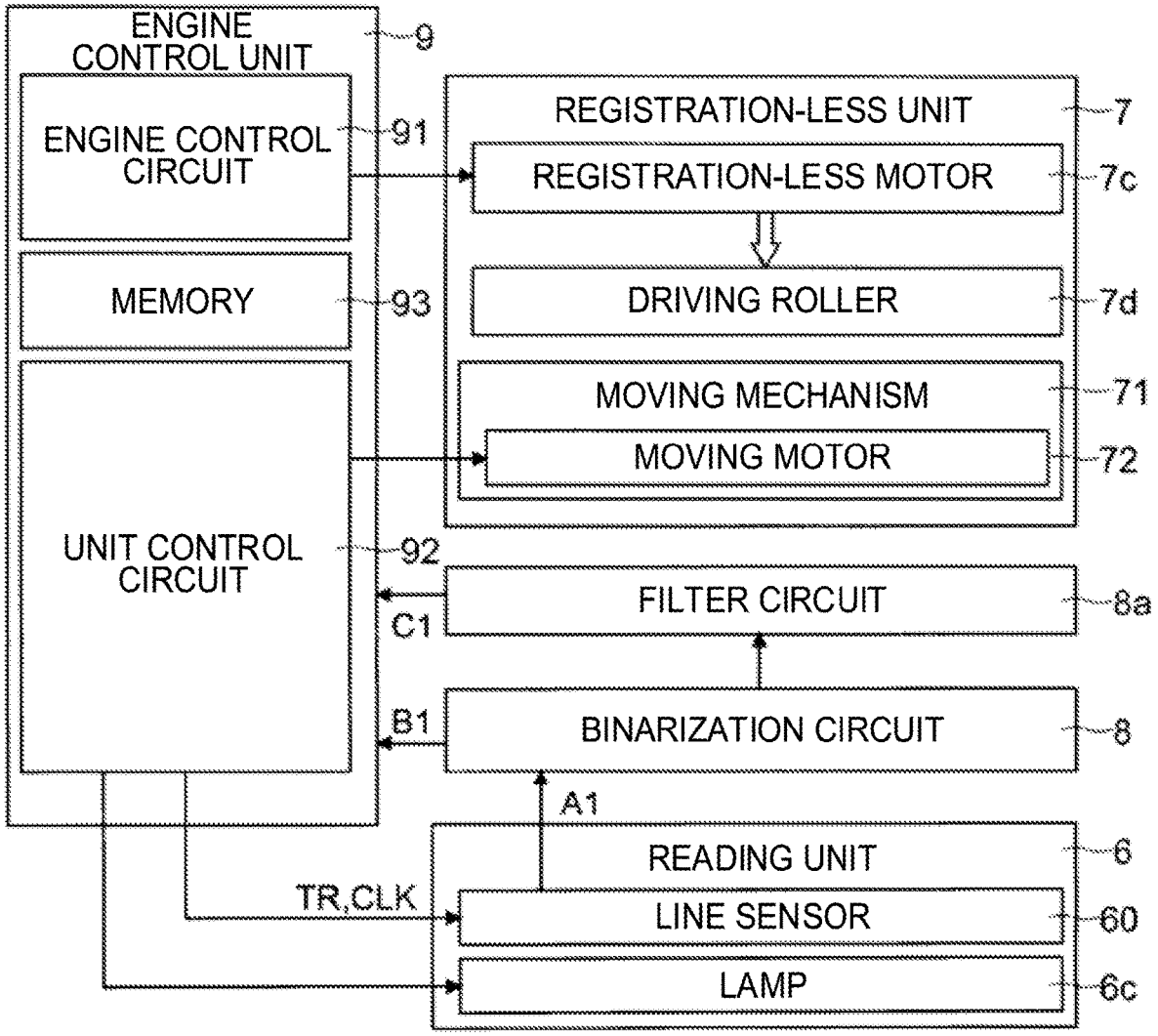
FIG. 7 is a diagram illustrating an example of the multifunction peripheral according to the embodiment.

Next, an example of a reading unit 6 and a registration-less unit 7 according to the embodiment will be described with reference to FIGS. 4 to 7. FIG. 4 is a diagram illustrating an example of the reading unit 6 and the registration-less unit 7 according to the embodiment. FIG. 5 is a diagram illustrating an example of the reading unit 6 according to the embodiment. FIG. 6 is a diagram illustrating an example of the registration-less unit 7 according to the embodiment. FIG. 7 is a diagram illustrating an example of the multifunction peripheral 100 according to the embodiment.

The multifunction peripheral 100 includes the reading unit 6 and the registration-less unit 7. The reading unit 6 is provided on a sheet conveyance path. The reading unit 6 is provided on the upstream side of the image forming unit 5*c* (the secondary transfer nip 5*n* and the secondary transfer roller 57) in the sheet conveyance direction (see FIG. 2). As illustrated in FIG. 5, a light transmitting plate 6*b* is attached to one surface of the reading unit 6. The light transmitting plate 6*b* is a glass plate or a light transmissive resin plate. A lamp 6*c* and a line sensor 60 are disposed in the sealed space formed by a housing 6*a* and the light transmitting plate 6*b*. The reading unit 6 includes the lamp 6*c*, a lens 6*d*, and the line sensor 60. All or any one of the lamp 6*c*, the lens 6*d*, and the line sensor 60 may be incorporated in the case of the reading unit 6. The reading unit 6 reads a conveyance sheet by the contact image sensor (CIS) method.

As illustrated in FIG. 7, the engine control unit 9 includes the engine control circuit 91 and the unit control circuit 92. For example, the engine control circuit 91 is a CPU. The unit control circuit 92 is a CPU or a microcomputer. The unit control circuit 92 receives an instruction from the engine control circuit 91 and performs a predetermined process. Hereinafter, an example in which the unit control circuit 92 controls the operations of the reading unit 6 and the registration-less unit 7 will be described. Note that the engine control circuit 91 may control the operation of either one or both of the reading unit 6 and the registration-less unit 7.

FIG. 5 illustrates an example of an installation portion of the reading unit 6 in the sheet conveyance unit 5*b* (sheet conveyance path). FIG. 5 is a view of the sheet conveyance path viewed from a direction perpendicular to the sheet conveyance direction. At the time of a print job, the unit control circuit 92 supplies a current to the lamp 6*c* to turn on the lamp 6*c*. FIG. 5 illustrates an example in which the reading unit 6 includes two lamps 6*c*. The lamp 6*c* emits light along the main scanning direction. For example, the lamp 6*c* is a light emitting diode (LED) lamp.

The line sensor 60 includes a plurality of pixels (light-receiving elements). The pixels (light-receiving elements) are arranged in a main scanning direction. As illustrated in FIG. 5, the light emitted from the lamp 6*c* and reflected by a document is incident on each pixel of the line sensor 60 through the lens 6*d*. At the time of sheet conveyance (at the time of a print job), the unit control circuit 92 causes the line sensor 60 to perform a reading operation. The line sensor 60 may be used as a sensor for detecting that a sheet has arrived.

The line sensor 60 is divided into three blocks. Each block includes a pixel (light receiving element). For convenience, a first block 61, a second block 62, and a third block 63 are referred to in order from one side in the main scanning direction (on the right side in FIG. 4, and on the side of the fulcrum). In the multifunction peripheral 100, a sheet is conveyed by a central sheet passing method. In the sheet feeding unit 5*a*, the position of a sheet is regulated so that the center of the sheet conveyance path in the main scanning direction coincides with the center of the sheet in the main scanning direction. The sheet conveyance unit 5*b* conveys a sheet so that the center of the sheet conveyance path in the main scanning direction coincides with the center of the sheet in the main scanning direction. The broken line in FIG. 4 is a line showing the center of a sheet and the center of the sheet conveyance path in the main scanning direction.

The third block 63 is provided at a position where the center of a sheet in the main scanning direction is read. The third block 63 is a central reading block. The central reading block is a block including a central reading pixel that reads the center of a sheet to be conveyed (sheet conveyance path) in the main scanning direction. When a sheet having the largest width in the main scanning direction is used among printable sheets, the first block 61 is provided at a position to read an end of the sheet on one side in the main scanning direction.

The unit control circuit 92 inputs a trigger signal TR and a read clock signal CLK to the line sensor 60. The line sensor 60 includes a charge transfer circuit (shift register, transfer CCD). For example, the electric charge stored in each pixel is transferred to the charge transfer circuit in accordance with the trigger signal TR. The charge transfer circuit outputs an analog image signal A1 for one pixel for each read clock signal CLK while converting the electric charge into a voltage.

The registration-less unit 7 is provided at the installation position of the pair of registration rollers in the conventional image forming device. The conventional pair of registration rollers has stopped when a sheet arrives. The skew of the sheet is corrected by abutting the sheet against the pair of registration rollers that are being stopped. However, when the pair of registration rollers is used, the conveyance of the sheet is temporarily stopped. The registration-less unit 7 corrects the skew, but conveys the sheet toward the downstream side without stopping the sheet.

As illustrated in FIG. 2, the registration-less unit 7 is provided on the upstream side of the image forming unit 5*c* (the intermediate transfer unit, the secondary transfer nip 5*n*, and the secondary transfer roller 57) in the sheet conveyance direction. The registration-less unit 7 is provided on the downstream side of the reading unit 6 in the sheet conveyance direction.

As illustrated in FIG. 6, the registration-less unit 7 includes a case 7*a*. In the example illustrated in FIG. 6, the case 7*a* is box-shaped, and the longitudinal direction of the case 7*a* is along the main scanning direction. The registration-less unit 7 (case 7*a*) includes a pair of registration-less rollers 7*b* and a registration-less motor 7*c*. The pair of registration-less rollers 7*b* includes a driving roller 7*d* and a driven roller 7*e*. The axial directions of the driving roller 7*d* and the driven roller 7*e* are parallel to each other. The peripheral surface of the driving roller 7*d* is in contact with the peripheral surface of the driven roller 7*e*.

A gear is attached to one end of the rotation shaft of the driving roller 7*d*. The gear meshes with a gear provided on the shaft of the registration-less motor 7*c*. When the registration-less motor 7*c* rotates, the driving roller 7*d* and the driven roller 7*e* also rotate.

A fulcrum axis 7*f* (fulcrum, pivot shaft) is provided at an end portion on one side of the registration-less unit 7 in the main scanning direction (the direction perpendicular to the sheet conveyance direction). The registration-less unit 7 can be rotated by the fulcrum axis 7*f* so as to swing an end portion on the other side of the registration-less unit 7. In FIG. 4, as indicated by the solid line arrow, it is possible to swing the end portion on the other side of the registration-less unit 7 toward the downstream side or the upstream side in the sheet conveyance direction.

The multifunction peripheral 100 includes a moving mechanism 71. In order to correct the skew of a sheet, the moving mechanism 71 moves the end portion on the other side (moving side) of the registration-less unit 7. The moving mechanism 71 includes a member that moves the end portion on the other side of the registration-less unit 7. For example, the moving mechanism 71 includes a moving motor 72, a driving pulley 73, a driven pulley 74, and a belt 75.

The moving motor 72 is rotatable in both the forward direction and the reverse direction. The unit control circuit 92 controls the rotation of the moving motor 72. The belt 75 is wound around the driving pulley 73 and the driven pulley 74. The moving motor 72 rotates the driving pulley 73. A portion of the belt 75 and an end portion on the other side of the registration-less unit 7 (case 7*a*) are connected to each other. The registration-less unit 7 moves around the fulcrum (fulcrum axis 70 by rotating the moving motor 72 and the driving pulley 73. It is possible to move the end portion on the other side of the registration-less unit 7 (case 7*a*) in accordance with the movement of the belt 75. For example, the movement amount of the registration-less unit 7 in the skew correction is less than several millimeters. Moving the end portion on the other side with the belt 75 allows to correct the skew (inclination) of a sheet while the sheet is being conveyed.

Conveyance read image data (binarization signal B1) is generated, based on the analog image signal A1 output by each pixel of the reading unit 6 (line sensor 60) (the details will be described later). The unit control circuit 92 recognizes an inclination angle θ of a sheet based on the conveyance read image data. The unit control circuit 92 moves the registration-less unit 7 in accordance with the inclination angle θ to correct the skew.

(Binarization Circuit 8 and Calculation Related to Skew)

Figure 8:
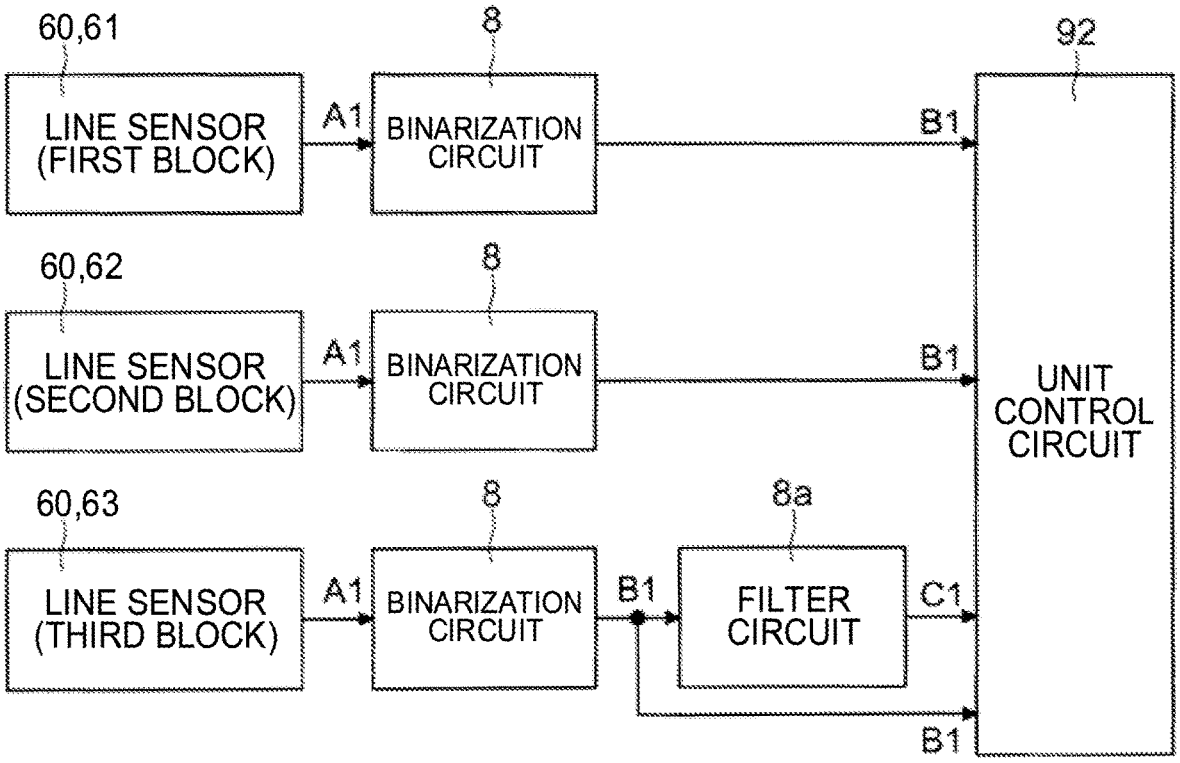
FIG. 8 is a diagram illustrating an example of a circuit included in the multifunction peripheral according to the embodiment.
Figure 9:
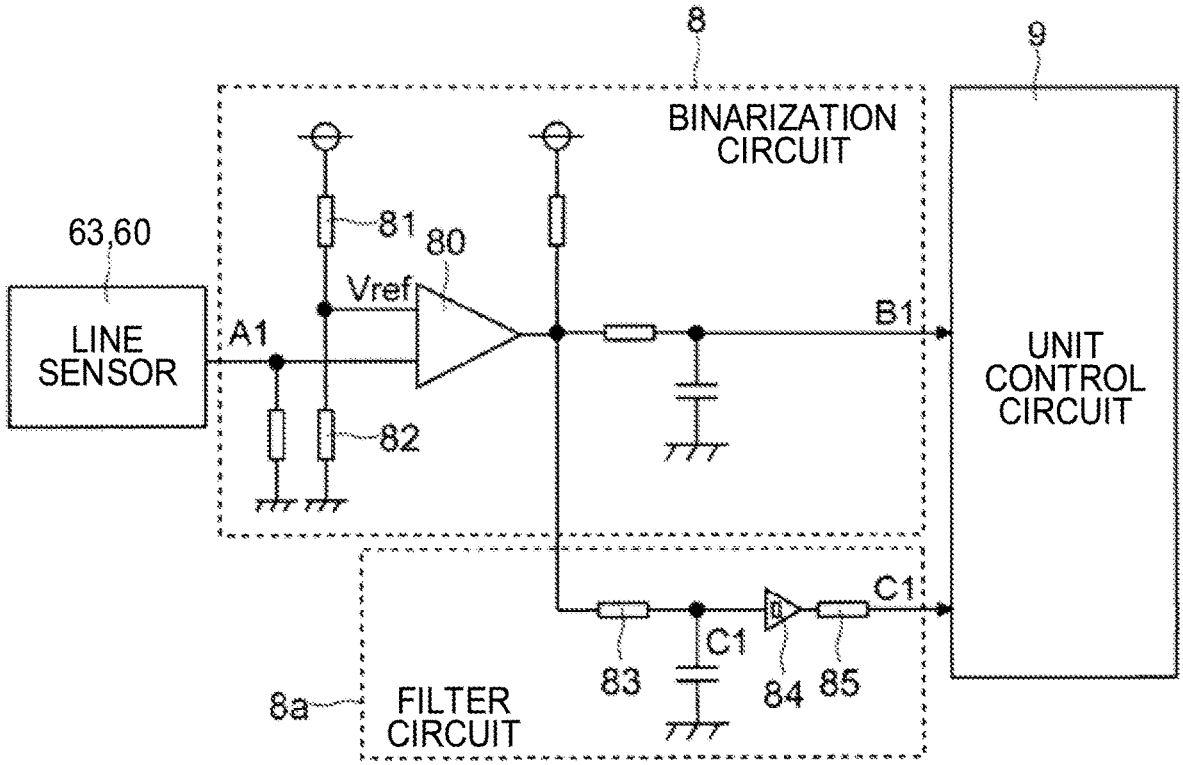
FIG. 9 is a diagram illustrating an example of a binarization circuit and a filter circuit according to the embodiment.
Figure 10:
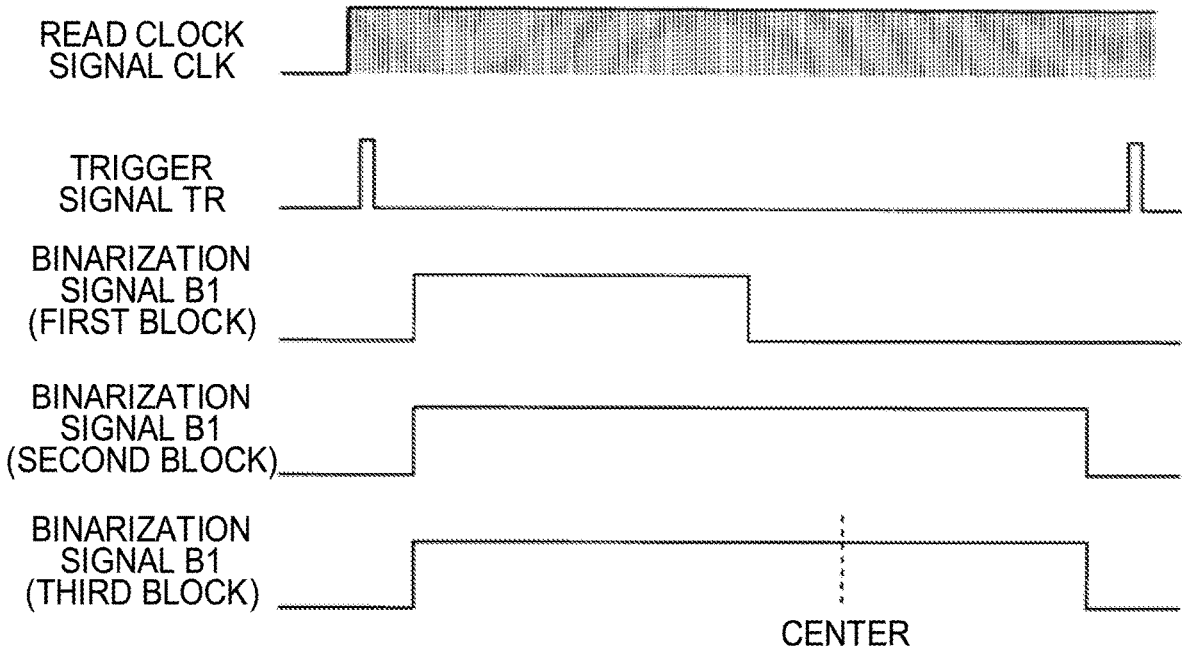
FIG. 10 is a diagram illustrating an example of a timing chart of each signal when the reading unit according to the embodiment reads a sheet.

Next, an example of the binarization circuit 8 and the calculation related to the skew according to the embodiment will be described with reference to FIGS. 8 to 10. FIG. 8 is a diagram illustrating an example of a circuit included in the multifunction peripheral 100 according to the embodiment. FIG. 9 is a diagram illustrating an example of the binarization circuit 8 and a filter circuit 8*a* according to the embodiment. FIG. 10 is a diagram illustrating an example of a timing chart of each signal when the reading unit 6 according to the embodiment reads a sheet.

The binarization circuit 8 is a circuit that binarizes the analog image signal A1 of each pixel output from the line sensor 60. When the voltage value of the analog image signal A1 is larger than a predetermined threshold value Vref, the binarization circuit 8 outputs the High level. When the voltage value of the analog image signal A1 is equal to or less than the threshold value Vref, the binarization circuit 8 outputs the Low level. The binarization allows to obtain the conveyance read image data (binarization signal B1) in monochrome (one pixel one bit).

In a portion where there is a sheet, the light of the lamp 6*c* is reflected by the sheet, and the amount of light incident on the pixel (light receiving element) increases. In a portion where there is no sheet, the light of the lamp 6*c* travels toward the wall surface of the sheet conveyance path. The amount of light incident on the pixel is reduced. Among the conveyance read image data, the High level indicates the portion in which the there is a sheet (pixel that has read the sheet). The Low level indicates the portion where there is no sheet (pixel that has not read the sheet).

As described above, the line sensor 60 includes the three blocks (the first block 61, the second block 62, and the third block 63). The binarization circuit 8 is provided for each block. The analog image signal A1 of each pixel in the first block 61 is input to the first one of the binarization circuits 8. The analog image signal A1 of each pixel in the second block 62 is input to the second one of the binarization circuits 8. The analog image signal A1 of each pixel in the third block 63 is input to the third one of the binarization circuits 8.

Each of the binarization circuits 8 has the same configuration. FIG. 9 illustrates an example of the binarization circuit 8. The binarization circuit 8 includes a comparator 80 and a plurality of resistors. The output (analog image signal A1) of the line sensor 60 is input to an input terminal on one side of the comparator 80 in order by one pixel. The analog image signals A1 of each pixel are sequentially input to the comparator 80 in the cycle of the read clock signal CLK. A reference voltage (threshold Vref) generated by dividing a voltage with a first resistor 81 and a second resistor 82 is input to an input terminal on the other side of the comparator 80.

The amount of light received by a pixel that has read a sheet increases, and the charge accumulated in the pixel increases. The voltage value of the analog image signal A1 of the pixel that has read the sheet is larger than the voltage value of the analog image signal A1 of a pixel that has not read the sheet. The larger the voltage value of the analog image signal A1 is, the brighter (white, light color) the sheet read by the pixel is. The comparator 80 binarizes the analog image signal A1. The comparator 80 outputs the High level or the Low level in accordance with the result of comparison between the voltage value of the analog image signal A1 and the threshold value Vref.

The output of each of the binarization circuits 8 (binarization signal B1, conveyance read image data) is input to the unit control circuit 92. The unit control circuit 92 latches the output level of the binarization circuit 8 in the cycle of the read clock signal CLK. Accordingly, the unit control circuit 92 obtains binary image data (conveyance read image data) generated by the binarization circuit 8. The unit control circuit 92 can recognize that which pixel in order of each block is the High level and which pixel in order of each block is the Low level. The unit control circuit 92 recognizes the inclination direction and the inclination angle θ of the conveyance sheet, based on the conveyance read image data.

FIG. 10 illustrates an example of a signal output by each of the binarization circuits 8 when a certain line on a sheet is read. The uppermost chart in FIG. 10 shows the read clock signal CLK. For example, the frequency of the read clock signal CLK is greater than or equal to several MHz. The second chart from the top in FIG. 10 shows an example of the trigger signal TR. The third chart from the top in FIG. 10 shows an example of the waveform of the binarization signal B1 of the analog image signal A1 from the first block 61. The fourth chart from the top in FIG. 10 shows an example of the waveform of the binarization signal B1 of the analog image signal A1 from the second block 62. The fifth chart from the top in FIG. 10 shows an example of the waveform of the binarization signal B1 of the analog image signal A1 from the third block 63. The broken line in the fifth chart from the top indicates the position of the pixel to read the center of the sheet that is not inclined in the main scanning direction and the sheet conveyance path (central reading pixel).

For example, the unit control circuit 92 obtains the total number of pixels with the High level at the outer side (one side) in the main scanning direction, from the number of pixels with the High level in the third chart (the number of read clock signal CLKs), the number of pixels with the High level in the fourth chart, and the central reading pixel in the fifth chart. The unit control circuit 92 obtains a multiplication value obtained by multiplying the total value by the pitch of one pixel. The multiplication value indicates ½ of the length of the sheet in the main scanning direction. The unit control circuit 92 can obtain the size of the sheet in the main scanning direction by multiplying the multiplication value by 2.

Further, the unit control circuit 92 can also obtain the inclination angle θ of the conveyance sheet. For example, two pixels (reference point pixels) for obtaining the inclination are predetermined. The reference point pixels are provided within the reading range of the smallest sheet that can be used for printing according to the specification. For example, the distance between the reference point pixels in the main scanning direction may be greater than ½ of the width of the smallest sheet that can be used for printing in the main scanning direction.

When the two reference point pixels become the High level on the same line, the unit control circuit 92 recognizes that the inclination angle θ is zero (not inclined). When one of the two reference point pixels becomes the High level earlier, the unit control circuit 92 recognizes that the conveyance sheet is inclined. When the reference point pixel on one side in the main scanning direction becomes the High level earlier, the unit control circuit 92 recognizes that a corner of the sheet on one side in the main scanning direction is inclined in the direction of projecting to the downstream side. When the reference point pixel on the other side in the main scanning direction becomes the High level earlier, the unit control circuit 92 recognizes that the corner of the sheet on the other side in the main scanning direction is inclined in the direction of projecting to the downstream side.

When the conveyance sheet is inclined, the unit control circuit 92 calculates the arc tangent ($\tan^{-1}$), and obtains the inclination angle θ. Specifically, the unit control circuit 92 performs the following calculation.

$$\text{The inclination angle } \theta = \tan^{-1}(a/b)$$

Here, a denotes the sheet conveyance distance from when one of the reference point pixels becomes the High level to when the other of the reference point pixels becomes the High level. For example, the unit control circuit 92 multiplies the number of lines from the time when one of the reference point pixels becomes the High level to when the other of the reference point pixels becomes the High level, the cycle of one line, and the sheet conveyance speed per unit time, to obtain a. b is the distance between the two reference point pixels. b can be obtained by multiplying the number of pixels from one of the reference point pixels to the other of the reference point pixels by the pitch of one pixel. The inclination angle θ is obtained based on a right triangle having a as the height and b as the base.

(Recognition that Sheet Reaches Line Sensor 60)

Next, with reference to FIG. 9, an example of recognizing that a sheet has reached the line sensor 60 in the multifunction peripheral 100 according to the embodiment will be described.

The unit control circuit 92 recognizes that a downstream end of a sheet to be conveyed reaches the line sensor 60, based on the analog image signal A1 output by the line sensor 60. The downstream end is an end side of the sheet on the downstream side in the sheet conveyance direction. The third block 63 reads the center of the sheet in the main scanning direction. That is, regardless of the size of the sheet used for printing, the third block 63 also reads the sheet. Therefore, the unit control circuit 92 recognizes that the sheet has reached the line sensor 60, based on the analog image signal A1 output from the third block 63 of the line sensor 60.

Specifically, the unit control circuit 92 recognizes the time when the sheet has reached the line sensor 60, based on an output signal C1 of the filter circuit 8*a*. For example, the output signal C1 of the filter circuit 8*a* is input to an interrupt terminal of the unit control circuit 92. The filter circuit 8*a* includes a first filter resistor 83, a capacitor C1, a Schmitt trigger buffer 84, and a second filter resistor 85.

One end of the first filter resistor 83 is connected to an output terminal of the comparator 80. That is, the binarization signal B1 (conveyance read image data) is input to the first filter resistor 83. The other end of the first filter resistor 83 is connected to one end of the capacitor C1 and an input terminal of the Schmitt trigger buffer 84. An output terminal of the Schmitt trigger buffer 84 is connected to one end of the second filter resistor 85. The other end of the second filter resistor 85 is connected to an input terminal (interrupt terminal) of the unit control circuit 92.

When the level change of the input signal to the filter circuit 8*a* is high speed, the output signal C1 of the filter circuit 8*a* is maintained at the Low level. It is possible to prevent a signal whose High and Low levels change at high speed from being input to the interrupt terminal. When a predetermined ratio or more of pixels in the third block 63 read a sheet, the filter circuit 8*a* outputs the High level. In other words, when the binarization signals B1 from the predetermined ratio or more of pixels in the third block 63 become the High level, the filter circuit 8*a* outputs the High level. When the output signal C1 of the filter circuit 8*a* becomes the High level, the unit control circuit 92 recognizes that the sheet has reached the line sensor 60 (reading unit 6).

When the predetermined ratio of the pixels read the sheet in consideration of the case where the sheet is inclined, the filter circuit 8*a* outputs the High level. The unit control circuit 92 does not recognize that the sheet has reached by reading only a small part of the inclined sheet. The predetermined ratio is appropriately determined. The predetermined ratio is determined, for example, in the range from 30% to 70%. In the multifunction peripheral 100, the predetermined ratio is set to 50%. In the following description, an example in which the predetermined ratio is 50% will be described. The resistance value of the first filter resistor 83 and the capacitance of the capacitor C1 are determined so that the output signal C1 becomes the High level when the number of pixels that have read the sheet is equal to or greater than the predetermined ratio.

(Skew Correction)

Figure 11:
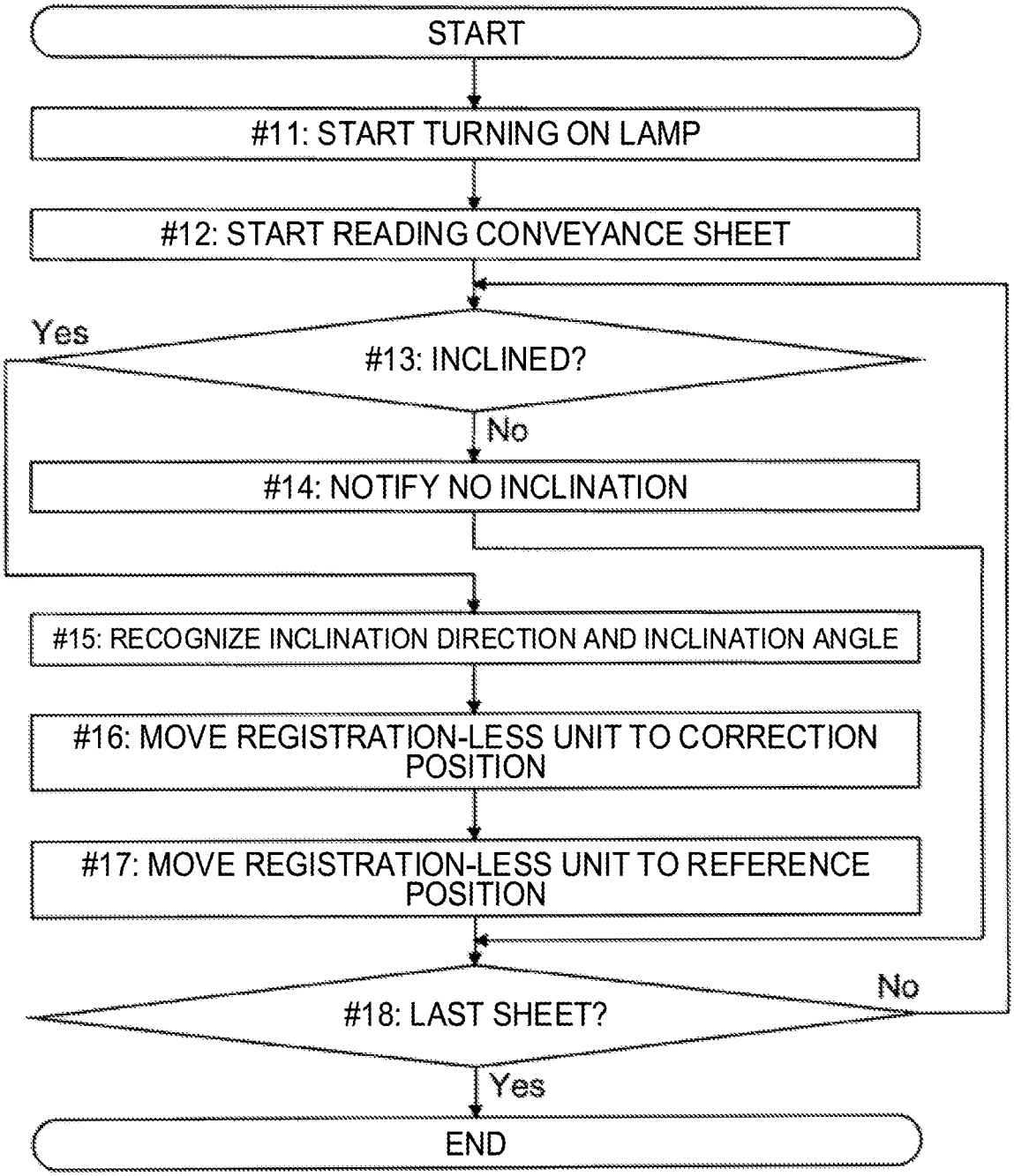
FIG. 11 is a diagram illustrating an example of skew correction in the multifunction peripheral according to the embodiment.

Next, an example of skew correction in the multifunction peripheral 100 according to the embodiment will be described with reference to FIG. 11. FIG. 11 is a diagram illustrating an example of skew correction in the multifunction peripheral 100 according to the embodiment.

The START in FIG. 11 is the start time of a print job. During the print job, the unit control circuit 92 causes the reading unit 6 to read each sheet. For example, when the feeding of a first sheet is started (when the rotation of the sheet feeding roller starts), the unit control circuit 92 starts turning on the lamp 6*c* (step #11). For example, the unit control circuit 92 starts to supply a current to the lamp 6*c*. Further, the unit control circuit 92 causes the line sensor 60 to start reading (step #12). The unit control circuit 92 starts inputting the trigger signal TR and the read clock signal CLK to the line sensor 60.

The unit control circuit 92 recognizes whether the sheet being read is inclined based on the conveyance reading image data (binary signal B1) output by the binarization circuit 8 (step #13). For example, the unit control circuit 92 monitors whether the two reference point pixels become the High level at the same time. When the unit control circuit 92 recognizes that the sheet is not inclined (No in step #13), the unit control circuit 92 notifies the engine control circuit 91 that the sheet is not inclined (step #14). When the unit control circuit 92 recognizes that the sheet is inclined (Yes in step #13), the unit control circuit 92 recognizes the inclination direction and inclination angle θ of the sheet being read (step #15).

Then, the unit control circuit 92 moves the registration-less unit 7 (case 7*a*) from a reference position to a correction position (step #16). The reference position is a position in which the axial direction of the rotation axis of the pair of registration-less rollers 7*b* is parallel to the main scanning direction (the direction perpendicular to the sheet conveyance direction). The unit control circuit 92 completes moving the registration-less unit 7 to the correction position before the sheet enters the registration-less unit 7. For example, after the unit control circuit 92 recognizes that the sheet has reached the line sensor 60, the unit control circuit 92 completes moving the registration-less unit 7 (case 7*a*) to the correction position before a first time elapses. The first time is a time obtained by dividing the distance from the reading position of the line sensor 60 (reading unit 6) to the nip of the pair of registration-less rollers 7*b* by a first speed. The first speed is a sheet conveyance speed in the specification (in terms of design) from the sheet feeding roller to the pair of registration-less rollers 7*b* (the details will be described later).

(1) When the sheet is skewed in a direction in which a corner on one side (fulcrum side) of the sheet in the main scanning direction protrudes toward the downstream side in the sheet conveyance direction.

The unit control circuit 92 moves the end portion on the other side (moving side) of the registration-less unit 7 in the main scanning direction to the upstream side in the sheet conveyance direction before the sheet has reached. The correction position is a position where the registration-less unit 7 is moved (rotated) by the same angle as the inclination angle θ from the reference position.

(2) When the sheet is skewed in a direction in which a corner on the other side (moving side) of the sheet in the main scanning direction protrudes toward the downstream side in the sheet conveyance direction.

The unit control circuit 92 moves the end portion on the other side of the registration-less unit 7 in the main scanning direction to the downstream side in the sheet conveyance direction before the sheet has reached. Also in this case, the correction position is a position where the registration-less unit 7 is moved (rotated) by the same angle as the inclination angle θ from the reference position.

Subsequently, the unit control circuit 92 moves the registration-less unit 7 (case 7*a*) from the correction position to the reference position (step #17). The unit control circuit 92 returns the registration-less unit 7 to a position where the skew of the sheet is corrected. By returning to the reference position, it is possible to correct the skew of the sheet while continuing to convey the sheet.

The unit control circuit 92 starts the movement to the reference position after the sheet has entered the registration-less unit 7 and before the sheet reaches the secondary transfer nip 5*n*. For example, after the unit control circuit 92 recognizes that the sheet has reached the line sensor 60, the unit control circuit 92 moves the registration-less unit 7 (case 7*a*) to the reference position when a second time elapses. The second time is a time obtained by adding a margin time to the time obtained by dividing the distance from the reading position (reading unit 6) of the line sensor 60 to the nip of the pair of registration-less rollers 7*b* by the first speed. The second time is longer than the first time. The margin time is predetermined so that the sheet enters the nip of the pair of registration-less rollers 7*b* and then returns to the reference position.

After step #14 or step #17, the unit control circuit 92 checks whether the last sheet of the print job has been read (step #18). In other words, the unit control circuit 92 checks whether the last sheet has passed the reading unit 6.

If there is not the last sheet (No in step #18), the unit control circuit 92 performs the step #13 for the next sheet (return to step #13). A sheet interval is provided between the sheets to be conveyed. The level of the output signal C1 of the filter circuit 8*a* becomes the Low level in the sheet interval. After the level of the output signal C1 of the filter circuit 8*a* becomes the Low level, the unit control circuit 92 monitors again whether the two reference point pixels become the High level.

In the case of the last sheet (No in step #18), the unit control circuit 92 ends the processing of the flowchart (END). When the unit control circuit 92 ends the flow chart, the unit control circuit 92 turns off the lamp 6*c*, and ends the reading of the line sensor 60.

(Change in Conveyance Speed)

Figure 12:
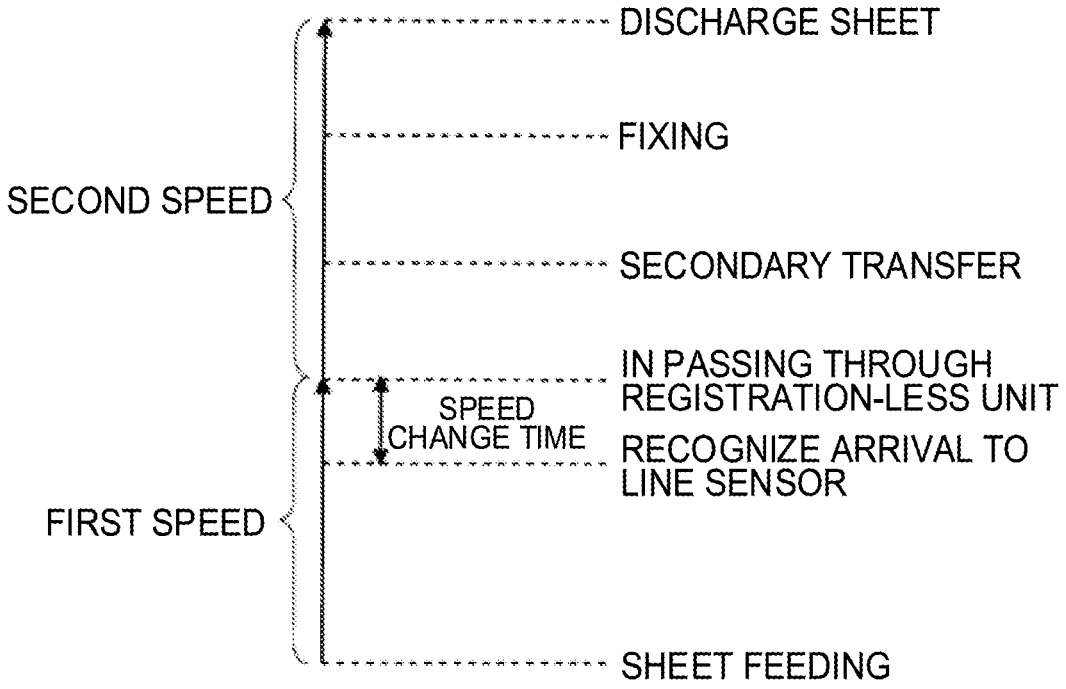
FIG. 12 is a diagram illustrating an example of a change in a sheet conveyance speed in the registration-less unit according to the embodiment.

Next, an example of the change in the sheet conveyance speed in the registration-less unit 7 according to the embodiment will be described with reference to FIG. 12. FIG. 12 is a diagram illustrating an example of the change in the sheet conveyance speed in the registration-less unit 7 according to the embodiment.

The engine control circuit 91 (engine control unit 9) changes the sheet conveyance speed while the pair of registration-less rollers 7*b* nips a sheet. As illustrated in FIG. 12, after the sheet feeding is started, the engine control circuit 91 conveys the sheet at the first speed until the sheet enters the registration-less unit 7. On the upstream side of the pair of registration-less rollers 7*b*, the sheet is conveyed at the first speed. Specifically, regarding each rotating body for sheet conveying on the upstream side of the registration-less unit 7 in the sheet conveyance direction, the engine control circuit 91 rotates each rotating body so that the peripheral speed becomes the first speed. The rotating body for sheet conveying on the upstream side of the registration-less unit 7 in the sheet conveyance direction includes, for example, a sheet feed roller and a pair of conveyance rollers provided on the sheet conveyance unit 5*b*.

While the sheet passes through the registration-less unit 7 (during entry), the engine control circuit 91 switches the sheet conveyance speed from the first speed to the second speed. The second speed is faster than the first speed. For example, the first speed is reduced by 10 to 20% from the second speed. For example, when the first speed is 400 mm/s, the second speed is 360 mm/s.

Regarding each rotating body for sheet conveying and toner image formation on the downstream side of the registration-less unit 7 in the sheet conveyance direction, the engine control circuit 91 rotates each rotating body so that the peripheral speed becomes the second speed. The rotating body on the downstream side of the registration-less unit 7 includes the photosensitive drum 53, the intermediate transfer belt 56, a fixing rotating body, a discharge roller pair, and the like.

When the sheet reaches the nip of the pair of registration-less rollers 7*b*, the engine control circuit 91 rotates the registration-less motor 7*c* so that the sheet is conveyed at the first speed. During the sheet conveyance of the pair of registration-less rollers 7*b*, the engine control circuit 91 increases the rotation speed of the registration-less motor 7*c* so that the sheet is conveyed at the second speed.

When the speed change time elapses from the recognition that the sheet has reached the line sensor 60, the engine control circuit 91 changes the rotation speed of the pair of registration-less rollers 7*b* from the first speed to the second speed. When the sheet is not inclined, the engine control circuit 91 sets a predetermined reference time T1 as the speed change time.

The reference time T1 can be determined as appropriate. The reference time T1 is determined from the time zone in which the downstream end of the sheet is located on the downstream side of the nip of the pair of registration-less rollers 7*b*, and before the downstream end of the sheet enters the secondary transfer nip 5*n*. For example, the time obtained by dividing the distance obtained by adding the conveyance distance from the line sensor 60 to the nip of the pair of registration-less rollers 7*b* and ½ of the conveyance distance from the pair of registration-less rollers 7*b* to the secondary transfer nip 5*n* by the first speed is determined as the reference time T1. In this case, the change to the second speed is made at a time when the downstream end of the sheet is located in the vicinity of the intermediate point from the pair of registration-less rollers 7*b* to the secondary transfer nip 5*n*.

(Setting of Speed Change Time)

Figure 13:
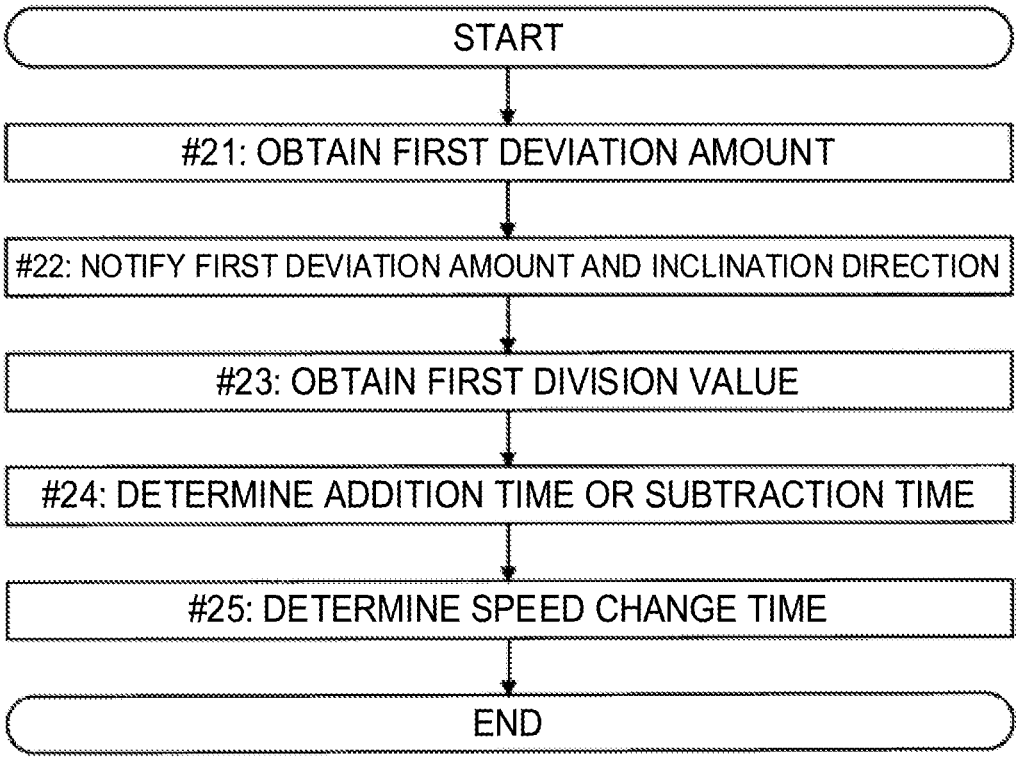
FIG. 13 is a diagram illustrating an example of setting a speed change time according to the embodiment.
Figure 14:
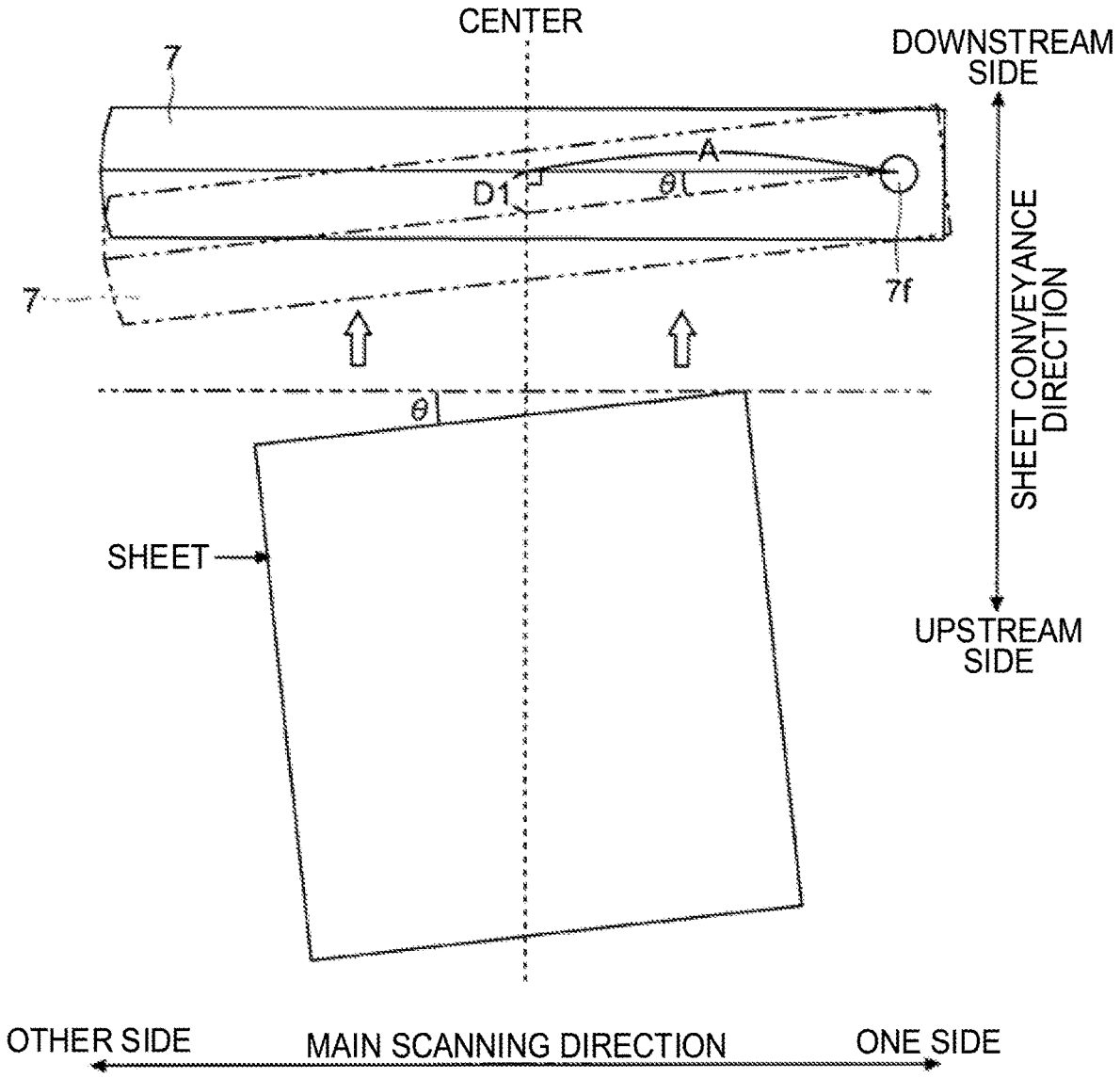
FIG. 14 is a diagram illustrating an example of setting the speed change time according to the embodiment.

Next, an example of the setting of the speed change time according to the embodiment will be described with reference to FIGS. 13 and 14. FIGS. 13 and 14 are diagrams illustrating an example of the setting of the speed change time according to the embodiment.

The skew can be corrected without stopping the sheet by moving the other end side of the registration-less unit 7. When the skew is corrected, the sheet is pulled up or pulled down in the sheet conveyance direction in the sheet conveyance direction. The position of the sheet changes while the sheet passes through the registration-less unit 7.

The timing (time point) at which the sheet reaches the position where an image is placed on the sheet (secondary transfer nip 5*n*) varies, depending on the presence or absence of the skew and the magnitude of the inclination angle θ. If the speed change time (the time from the recognition of the arrival to the line sensor 60 to the change to the second speed) is a fixed value, the drawing position of the image (position of the first line) may vary for each sheet, based on the influence of the position change of each sheet.

The registration-less unit 7 adjusts the deviation caused by the movement of the registration-less unit 7. Specifically, the engine control circuit 91 sets the speed change time for which the length has been adjusted in accordance with the movement amount of the position of the sheet due to the skew correction. The engine control circuit 91 sets the speed change time corresponding to the movement amount of the position of the sheet.

First, the reference time T1 is predetermined for the speed change time. The storage unit 2 stores the reference time T1 in a non-volatile manner (see FIG. 1). The reference time T1 is the speed change time when no sheet is inclined (when no skew is corrected). When the skew of a sheet is not corrected, the engine control circuit 91 uses the reference time T1 as the speed change time.

The START in FIG. 13 is a time point when the unit control circuit 92 recognizes that the sheet being read by the reading unit 6 is inclined (Yes in step #13 in FIG. 11). When the unit control circuit 92 recognizes that the sheet is not inclined, the unit control circuit 92 notifies the engine control circuit 91 that the sheet is not inclined. When the sheet is not skewed, there is no change in the position of the sheet due to the skew correction. When the engine control circuit 91 is notified that the sheet is not inclined, the engine control circuit 91 sets the reference time T1 to the speed change time.

When the unit control circuit 92 recognizes that the sheet is inclined, the unit control circuit 92 obtains a first deviation amount D1 (step #21). The first deviation amount D1 is a deviation amount of the position (the position of the downstream end) of the sheet based on the skew correction. The unit control circuit 92 obtains the first deviation amount D1 based on the obtained inclination angle θ.

A method for obtaining the first deviation amount D1 will be described with reference to FIG. 14. In FIG. 14, the center between the sheet conveyance path and the sheet in the main scanning direction is indicated by a broken line. The axis of the registration-less unit 7 and the pair of registration-less rollers 7*b* in the reference position is indicated by a solid line. The axis of the registration-less unit 7 and the pair of registration-less rollers 7*b* in the correction position is indicated by an alternative long and two short dashes line. In FIG. 14, the inclination angle θ is also illustrated.

The unit control circuit 92 obtains the first deviation amount D1 based on the following equation 1.

$$\text{The first deviation amount } D1 = A \times B \qquad \text{(Equation 1)}$$

A is the distance from the center of the sheet to the fulcrum. In other words, A is the length of a straight line connecting the center of the fulcrum axis 7*f* and the center of the sheet in the main scanning direction.

B is Tan θ.

FIG. 14 shows A and the first deviation amount D1. In the right triangle with an angle θ whose adjacent side (base) is a straight line connecting the center of the fulcrum axis 7*f* and the center of the sheet in the main scanning direction, the length (height) of the opposite side is the first deviation amount D1.

The unit control circuit 92 notifies the engine control circuit 91 of the obtained first deviation amount D1 and the inclination direction (Step #22). Note that the engine control circuit 91 may obtain the first deviation amount D1. In this case, the unit control circuit 92 notifies the engine control circuit 91 of the inclination angle θ and the inclination direction.

The engine control circuit 91 divides the first deviation amount D1 by the first speed to obtain a first division value, based on the notified first deviation amount D1 (step #23). The engine control circuit 91 determines the addition time or the subtraction time based on the first division value, (step #24). Then, the engine control circuit 91 determines the speed change time based on the determined addition time or subtraction time (step #25). In step #25, the processing of the flowchart ends (END).

(1) When a sheet is skewed in a direction in which a corner on one side (fulcrum side) of the sheet in the main scanning direction protrudes toward the downstream side in the sheet conveyance direction.

In this case, the engine control circuit 91 sets the first division value as the addition time. Then, the engine control circuit 91 sets the time obtained by adding the addition time to the reference time T1 as the speed change time.

When a sheet having a corner on one side (fulcrum side) protruding toward the downstream side is corrected, the sheet moves to the downstream side. This is because a corner on the other side of the sheet is pulled up by the correction. Note that the moving direction of the position of the sheet depends on the position and the inclination direction of the fulcrum axis 7*f*. Since the sheet moves in the advancing direction, it is preferable that the time to change to the second speed is delayed from the reference. Delaying from the reference allows to reduce the difference at the time of reaching the secondary transfer nip 5*n*, compared with a sheet with no skew.

Therefore, the engine control circuit 91 adds the addition time to the reference time T1 to make the speed change time longer than the reference. Further, as the absolute value of the first deviation amount D1 is larger, the addition time is larger. The larger the first deviation amount D1 is, the longer the speed change time is. The engine control circuit 91 determines the speed change time corresponding to the first deviation amount D1.

(2) When a sheet is skewed in a direction in which a corner on the other side (the moving end side of the registration-less unit 7) of the sheet in the main scanning direction protrudes toward the downstream side in the sheet conveyance direction.

In this case, the engine control circuit 91 sets the first division value as the subtraction time. Then, the engine control circuit 91 determines the time obtained by subtracting the subtraction time from the reference time T1 as the speed change time.

When a sheet having a corner on the other side (the moving end side of the registration-less unit 7) protruding the downstream side is corrected, the sheet moves to the upstream side. This is because the corner on other side of the sheet is pulled back by the correction. It is preferable that the time to change to the second speed is hastened from the reference since the sheet moves in the direction in which the sheet is returned. Hastening from the reference allows to reduce the difference at the time of reaching the secondary transfer nip 5*n*, compared with a sheet with no skew.

The engine control circuit 91 subtracts the subtraction time from the reference time T1 to make the speed change time shorter than the reference. Further, as the absolute value of the first deviation amount D1 is larger, the subtraction time is larger. The larger the first deviation amount D1 is, the shorter the speed change time is. The engine control circuit 91 determines the speed change time corresponding to the first deviation amount D1.

(Correction of Speed Change Time)

Figure 15:
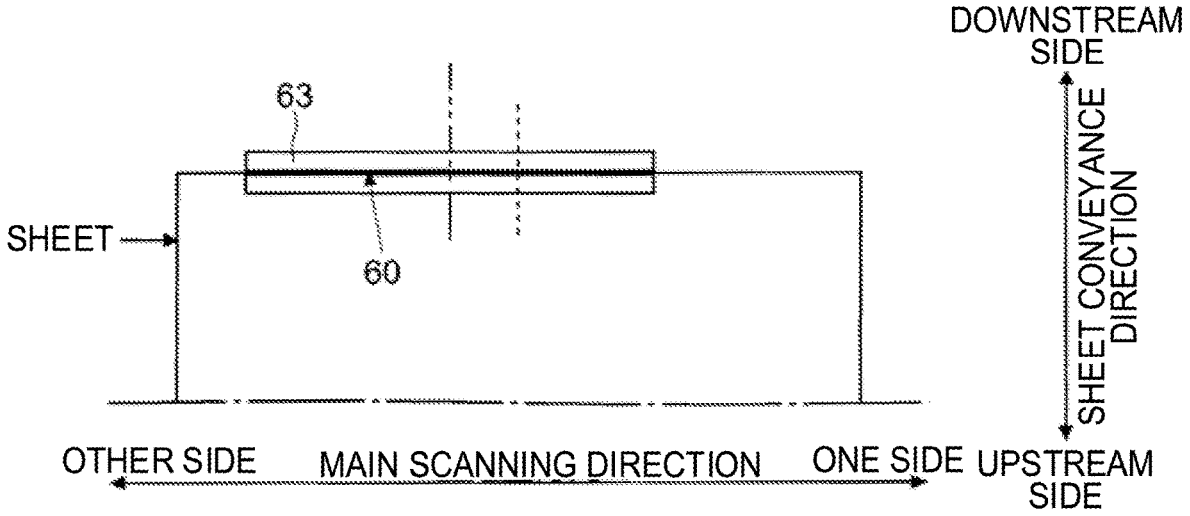
FIG. 15 is a diagram illustrating an example of reading a sheet by a line sensor according to the embodiment.
Figure 16:
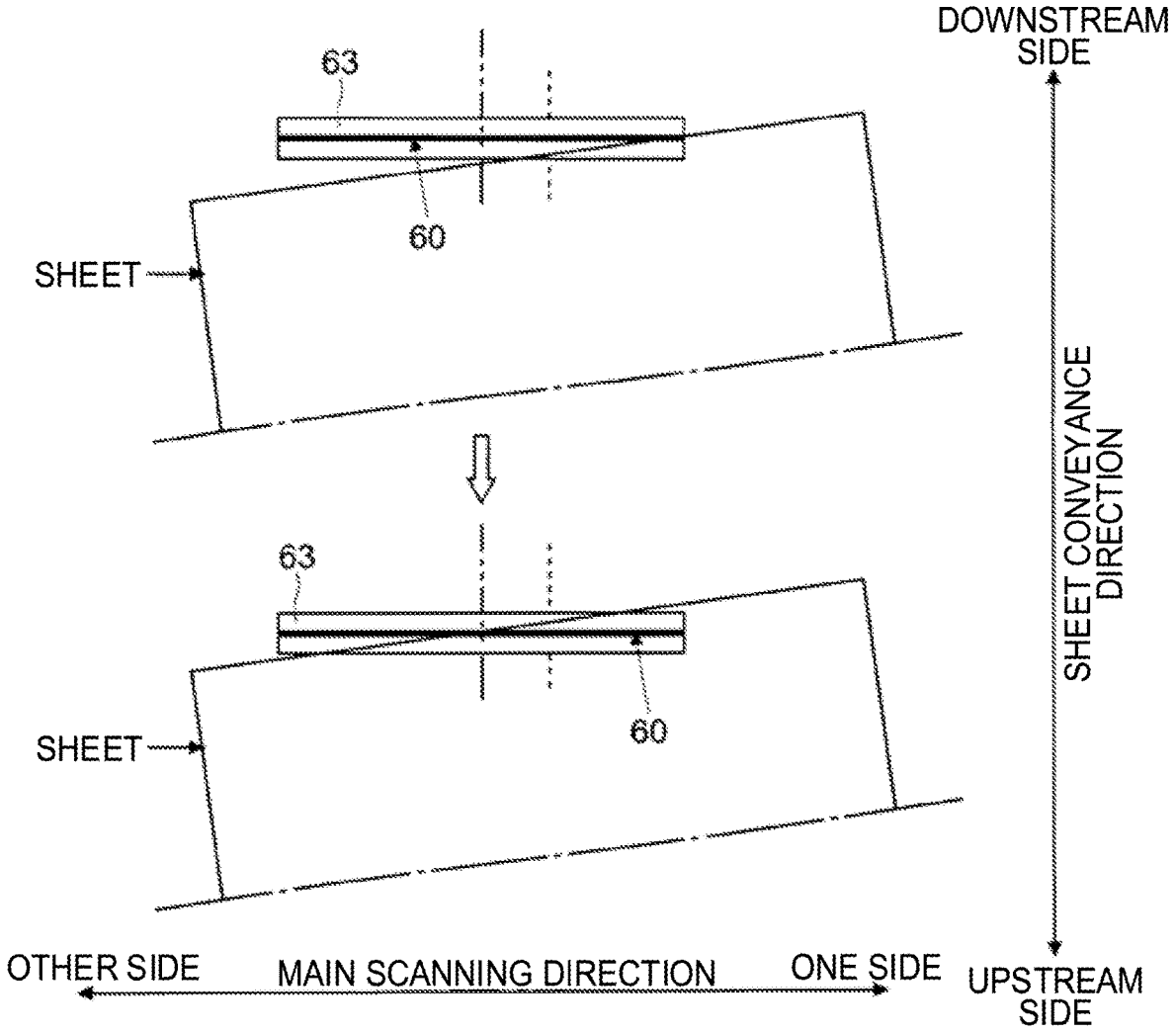
FIG. 16 is a diagram illustrating an example of reading a sheet by the line sensor according to the embodiment.
Figure 17:
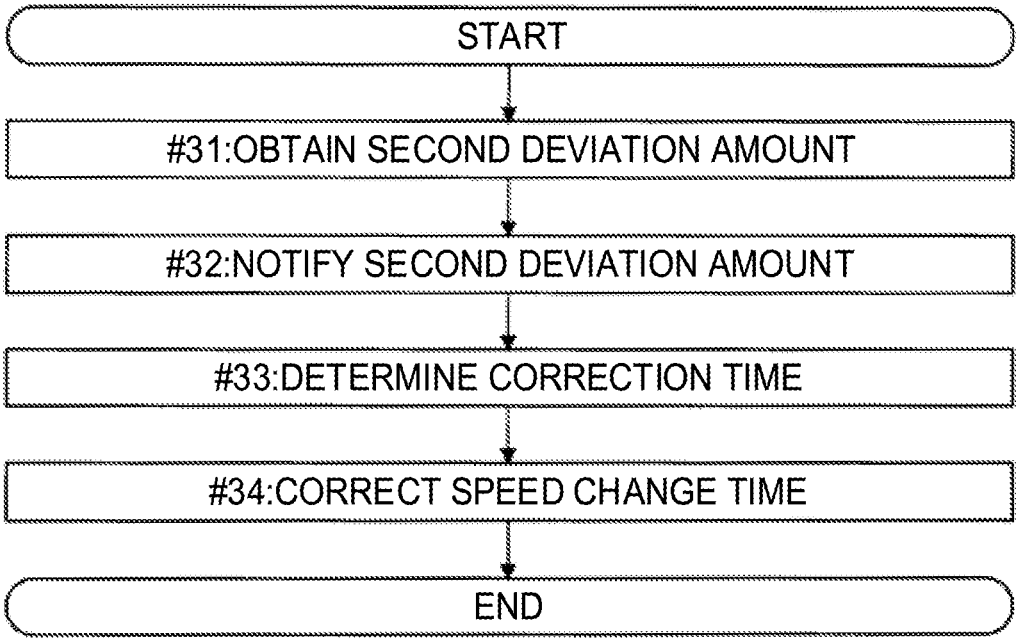
FIG. 17 is a diagram illustrating an example of correction of the speed change time according to the embodiment.
Figure 18:
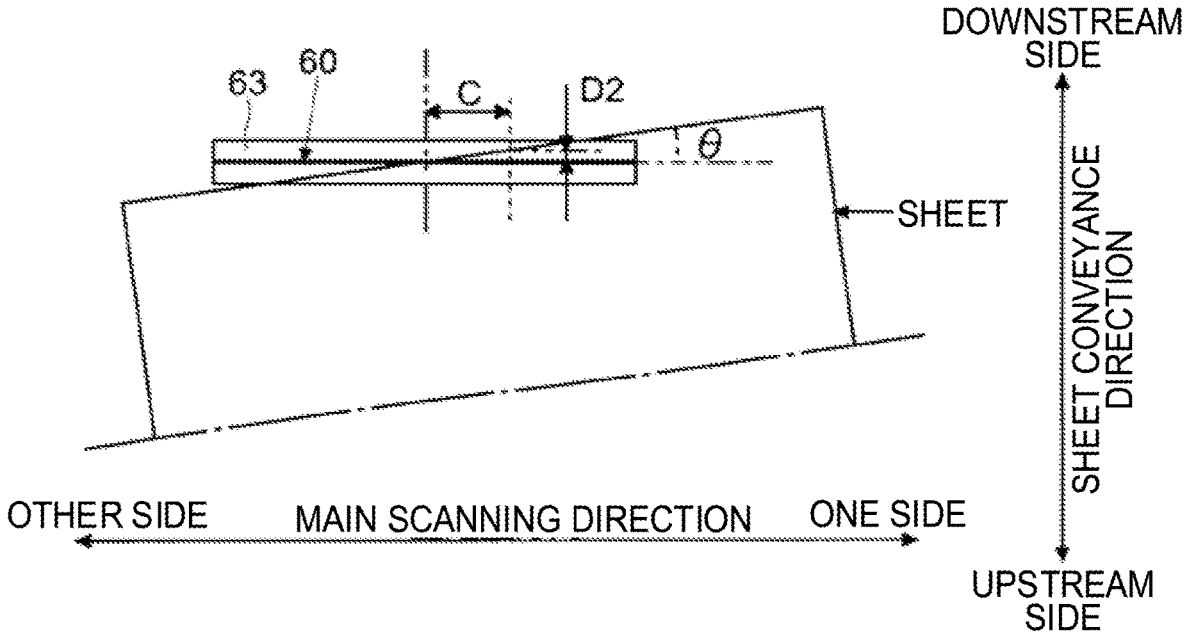
FIG. 18 is a diagram illustrating an example of a second deviation amount according to the embodiment.
Figure 19:
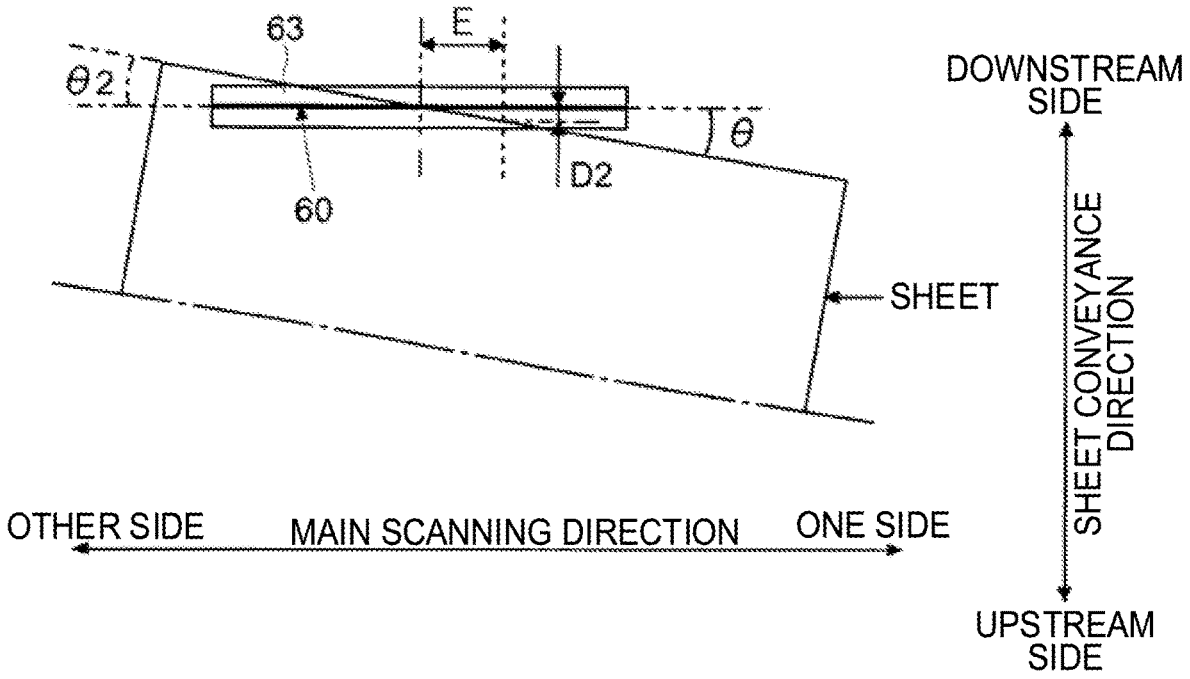
FIG. 19 is a diagram illustrating an example of the second deviation amount according to the embodiment.

Next, an example of correcting the speed change time according to the embodiment will be described with reference to FIGS. 15 to 19. FIGS. 15 and 16 are diagrams illustrating an example of reading a sheet by the line sensor 60 according to the embodiment. FIG. 17 is a diagram illustrating an example of correcting the speed change time according to the embodiment. FIGS. 18 and 19 are diagrams illustrating an example of a second deviation amount D2 according to the embodiment.

As described above, the unit control circuit 92 recognizes that a sheet has reached the line sensor 60. Specifically, when the predetermined ratio of pixels in the third block 63 reads the sheet (when the output signal C1 becomes the High level), the unit control circuit 92 recognizes that the sheet has reached the line sensor 60.

When the sheet is not inclined, the predetermined ratio or more of the pixels read the sheet, immediately after starting to read the sheet that has reached the line sensor 60. FIG. 15 illustrates an example of reading a sheet that is not inclined. The bold line in FIG. 15 indicates the line sensor 60. The broken line in FIG. 15 indicates the center of the sheet in the main scanning direction and the position of the central reading pixel. The alternative long and two short dashes line in FIG. 15 indicates the center of the third block 63 in the main scanning direction.

As illustrated in FIG. 15, in case that the sheet is not inclined, when the downstream end of the sheet reaches, the analog image signals A1 (binarization signal B1) of all the pixels in the third block 63 change from the Low level to the High level. All the pixels in the third block 63 simultaneously read the sheet to be conveyed.

FIG. 16 illustrates an example of reading an inclined sheet. The bold line in FIG. 16 indicates the line sensor 60. In FIG. 16, too, the broken line indicates the center of the sheet in the main scanning direction and the position of the central reading pixel. The alternative long and two short dashes line in FIG. 16 indicates the center of the third block 63 in the main scanning direction. Note that each sheet in FIG. 16 and thereafter is drawn with a larger inclination than the actual inclination of the sheet for the sake of clarity.

When a sheet to be conveyed is inclined, as illustrated in the upper view of FIG. 16, first, only a part of the pixels in the third block 63 reads the sheet. As illustrated in the lower view of FIG. 16, the number of pixels which have read the sheet increases as the conveyance of the sheet is progressed. After the reading of the sheet is started, the unit control circuit 92 recognizes that the sheet has arrived when the number of pixels that have read the sheet exceeds the predetermined ratio. When the sheet is inclined, the time when the unit control circuit 92 recognizes that the sheet has arrived is shifted (delayed), as compared with the case where the sheet is not inclined.

The reference time T1 is set so that the printing position of the sheet that is not inclined becomes appropriate. The engine control unit 9 (engine control circuit 91) corrects the speed change time, considering that the recognition time that the sheet has reached the line sensor 60 shifts depending on the presence or absence of the inclination.

Next, an example of correcting the speed change time will be described with reference to FIG. 17. As illustrated in the flowchart of FIG. 13, the engine control circuit 91 determines the speed change time. Further, the engine control circuit 91 corrects the determined speed change time. The START in FIG. 17 is also at the time when the unit control circuit 92 recognizes that the sheet to be read by the reading unit 6 is inclined (Yes in step #13 in FIG. 11). When the unit control circuit 92 recognizes that the sheet is not inclined, the unit control circuit 92 notifies the engine control circuit 91 that the sheet is not inclined. When the engine control circuit 91 receives the notification, the engine control circuit 91 does not correct the speed change time.

When the unit control circuit 92 recognizes that the sheet is inclined, the unit control circuit 92 obtains the second deviation amount D2 (step #31). The unit control circuit 92 obtains the second deviation amount D2, based on the obtained inclination angle θ, the inclination direction, and the analog image signal A1 output from the central reading block.

(1) When a corner on one side (fulcrum side) of the sheet in the main scanning direction is inclined in a direction protruding toward the downstream side in the sheet conveyance direction.

An example of how to obtain the second deviation amount D2 in this inclination direction will be described with reference to FIG. 18. The broken line in FIG. 18 indicates the center of the sheet conveyance path in the main scanning direction and the position of the central reading pixel. The central reading pixel is a pixel that reads the center of the sheet that is not inclined and the sheet conveyance path in the main scanning direction. The alternative long and two short dashes line in FIG. 18 indicates the center of the line sensor 60 in the third block 63. In the present description, the predetermined ratio is 50%. In the present description, when all the pixels on the right side or all the pixels on the left side of the alternative long and two short dashes line read the sheet, the unit control circuit 92 recognizes that the sheet has arrived.

When a corner on one side (fulcrum side) of the sheet is inclined so as to protrude toward the downstream side, the unit control circuit 92 obtains the second deviation amount D2 based on the following equation 2.

$$\text{The second deviation amount } D2 = C \times D \qquad \text{(Equation 2)}$$

C is the distance from a first vertex pixel to the central reading pixel. The first vertex pixel is a pixel closest to the central reading pixel among pixels each having a level representing that the level of the analog image signal A1 (binarization signal B1) indicates that the sheet has not been read at the time of recognizing that the sheet has arrived. The unit control circuit 92 recognizes the distance with reference to the conveyance read image data. D is Tan θ. FIG. 18 illustrates C and the second deviation amount D2. In the right triangle with the angle θ whose adjacent side (base) is a straight line connecting the first vertex pixel and the central reading pixel in the main scanning direction, the length (height) of the opposite side is the second deviation amount D2.

(2) When a corner on the other side (moving side) of the sheet in the main scanning direction is inclined in a direction protruding toward the downstream side in the sheet conveyance direction.

An example of how to obtain the second deviation amount D2 in this inclination direction will be described with reference to FIG. 19. The broken line in FIG. 19 indicates the position of the center of the sheet conveyance path in the main scanning direction and the position of the central reading pixel. The alternative long and two short dashes line in FIG. 19 indicates the center of the line sensor 60 in the third block 63.

When a corner on the moving end side of the sheet is inclined so as to protrude toward the downstream side, the unit control circuit 92 obtains the second deviation amount D2 based on the following equation 2.

$$\text{The second deviation amount } D2 = E \times F \qquad \text{(Equation 2)}$$

E is the distance from a second vertex pixel to the central reading pixel. The second vertex pixel is a pixel closest to the central reading pixel among pixels each having a level representing that the level of the analog image signal A1 (binarization signal B1) indicates that the sheet has been read at the time of recognizing that the sheet has arrived. The unit control circuit 92 recognizes the distance with reference to the conveyance read image data. D is Tan θ. FIG. 19 illustrates E and the second deviation amount D2. In the right triangle with the angle θ whose adjacent side (base) is a straight line connecting the second vertex pixel and the central reading pixel in the main scanning direction, the length (height) of the opposite side is the second deviation amount D2.

The unit control circuit 92 notifies the engine control circuit 91 of the obtained second deviation amount D2 (step #32). Note that the engine control circuit 91 may obtain the second deviation amount D2. The engine control circuit 91 divides the notified second deviation amount D2 by the first speed to obtain the correction time (step #33). The engine control circuit 91 corrects the speed change time based on the correction time (step #34). In step #34, the processing of the flowchart ends (END).

When the sheet is inclined, the recognition time of arrival is delayed as compared with the case where the sheet is not inclined. When the sheet is inclined, the unit control circuit 92 recognizes that the sheet has reached the line sensor 60 after the sheet has passed through the line sensor 60 to some extent. That is, when the sheet is inclined, the unit control circuit 92 recognizes that the sheet has reached the line sensor 60 after the sheet has further advanced, as compared with the case where the sheet is not inclined.

Therefore, when the speed change time that is not corrected when the sheet is inclined is used, the position of the downstream end of the sheet at the time of changing to the second speed may be further advanced to the downstream, as compared with the case of the sheet which is not inclined. In other words, in case of using the uncorrected speed change time, the time from the recognition that the sheet arrives at the line sensor 60 until the sheet arrives at the secondary transfer nip 5*n* may be shorter in the sheet whose inclination has been corrected than in the sheet without the inclination.

It may be considered to correct the speed change time to delay the arrival at the secondary transfer nip 5*n* for the inclined sheet. In other words, it is considered to perform adjustment for delaying the arrival of the sheet at the secondary transfer nip 5*n* by the correction time for the inclined sheet. Therefore, for example, the engine control circuit 91 may perform correction to add the correction time to the speed change time.

(Rotation Control of Pair of Registration-Less Rollers 7B)

Figure 20:
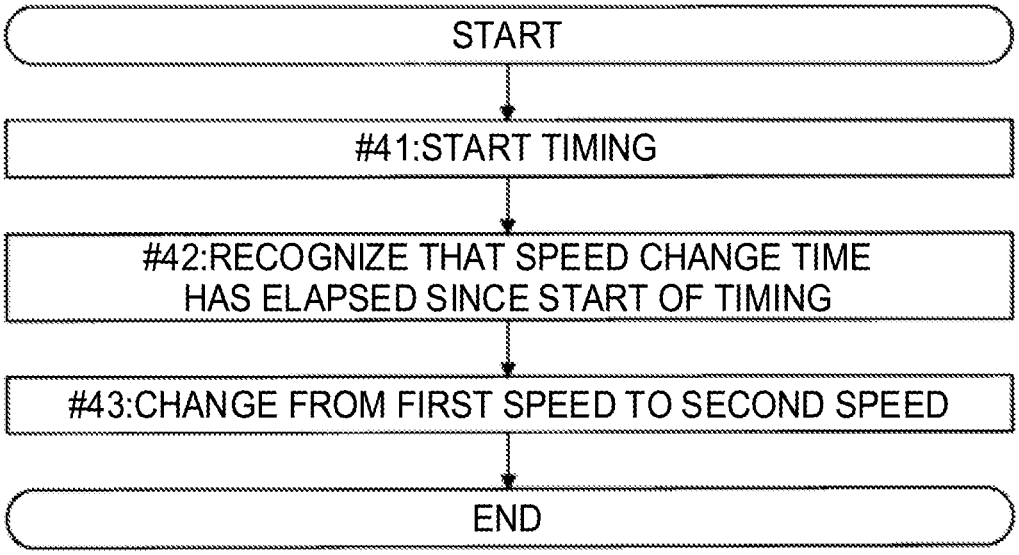
FIG. 20 is a diagram illustrating an example of rotationally controlling a pair of registration-less rollers according to the embodiment.

Next, an example of rotationally controlling the pair of registration-less rollers 7*b* according to the embodiment will be described with reference to FIG. 20. FIG. 20 is a diagram illustrating an example of rotationally controlling the pair of registration-less rollers 7*b* according to the embodiment.

The START in FIG. 20 is a time point when the unit control circuit 92 recognizes that a sheet has reached the line sensor 60. Note that the engine control unit 9 (the unit control circuit 92 and the engine control circuit 91) executes the flowchart of FIG. 20 for each sheet. At the START in FIG. 20, the engine control circuit 91 rotates the pair of registration-less rollers 7*b* at the first speed.

The engine control circuit 91 starts timing, based on the notification indicating that a sheet has reached the line sensor 60 from the unit control circuit 92 (step #41). After the start of timing, the engine control circuit 91 determines the speed change time, and corrects the speed change time, as necessary. Then, the engine control circuit 91 recognizes that the speed change time has elapsed since the start of timing (step #42). Then, the engine control circuit 91 changes the sheet conveyance speed of the pair of registration-less rollers 7*b* (the peripheral speed of the pair of registration-less rollers 7*b*) from the first speed to the second speed (step #43). Accordingly, the process of increasing the sheet conveyance speed of the pair of registration-less rollers 7*b* ends (END).

Note that, when the conveyed sheet is not the last sheet for the print job, the engine control circuit 91 returns the sheet conveyance speed of the pair of registration-less rollers 7*b* from the second speed to the first speed. Preparations are made for the next sheet. When the level of the output signal C1 of the filter circuit 8*a* becomes the Low level, the unit control circuit 92 recognizes that the sheet has passed. The unit control circuit 92 notifies the engine control circuit 91 that the sheet has passed through the line sensor 60. When the engine control circuit 91 receives the notification, the engine control circuit 91 may return from the second speed to the first speed. On the other hand, when the conveyed sheet is the last sheet for the print job, the engine control circuit 91 stops the pair of registration-less rollers 7*b* (the registration-less motor 7*c*).

In this way, the image forming device (the multifunction peripheral 100) according to the embodiment includes the image forming unit 5*c*, the reading unit 6, the registration-less unit 7, and the engine control unit 9 (the engine control circuit 91 and the unit control circuit 92). The image forming unit 5*c* forms an image on a sheet to be conveyed. The reading unit 6 is provided on the upstream side of the image forming unit 5*c* in the sheet conveyance direction. The reading unit 6 includes the line sensor 60, which is provided so that the pixels are arranged in the main scanning direction. The reading unit 6 reads the sheet to be conveyed. The registration-less unit 7 is provided on the upstream side of the image forming unit 5*c* in the sheet conveyance direction and on the downstream side of the reading unit 6 in the sheet conveying direction. The engine control unit 9 recognizes that the sheet has reached the line sensor 60 and the inclined angle θ of the sheet to be conveyed, based on the analog image signal A1 output by the line sensor 60. The engine control unit 9 controls the sheet conveyance speed. The registration-less unit 7 includes the pair of registration-less rollers 7*b*, the registration-less motor 7*c*, the case 7*a*, and the moving mechanism. The pair of registration-less rollers 7*b* feeds the sheet toward the image forming unit 5*c*. The registration-less motor 7*c* rotates the pair of registration-less rollers 7*b*. The case 7*a* accommodates the pair of registration-less rollers 7*b*, and has the fulcrum provided on one end side in the main scanning direction. The moving mechanism moves the other end side of the case 7*a* around the fulcrum in the sheet conveyance direction. When the sheet enters the nip of the pair of registration-less rollers 7*b*, the engine control unit 9 moves the other end side of the case 7*a* to the moving mechanism, and corrects the skew of the sheet. The engine control unit 9 obtains the first deviation amount D1, which is the deviation amount of the position of the sheet based on the correction. The engine control unit 9 rotates the pair of registration-less rollers 7*b* such that the sheet conveyance speed becomes the first speed when the downstream end side of the sheet reaches the registration-less unit 7 in the sheet conveyance direction. After the sheet enters the nip of the pair of registration-less rollers 7*b*, the engine control unit 9 rotates the pair of registration-less rollers 7*b* such that the sheet conveyance speed becomes the second speed. The engine control unit 9 adjusts the timing for changing from the first speed to the second speed, based on the first deviation amount D1.

The skew can be corrected by swinging (moving) one end of the sheet in the main scanning direction. Since the time point to change the conveyance speed is adjusted, the time from when the line sensor 60 recognizes that the sheet has arrived until the sheet reaches the position where an image is placed on the sheet (secondary transfer nip 5*n*) can be made constant. The timing at which the downstream end of the sheet reaches the image forming position can be made constant. The position of the first line for drawing can be the same regardless of any sheet. It is possible to prevent variations in the position where an image is printed.

The second speed is faster than the first speed. When the speed change time elapses from the recognition that the sheet has reached the line sensor 60, the engine control unit 9 changes from the first speed to the second speed. When the skew of the sheet is not corrected, the engine control unit 9 sets the predetermined reference time T1 as the speed change time. When the correction is performed to move the sheet to the downstream side in the sheet conveyance direction, the engine control unit 9 sets the time obtained by adding the addition time to the reference time T1 as the speed change time. When the correction is performed to move the sheet to the upstream side in the sheet conveyance direction, the engine control unit 9 sets the time obtained by subtracting the subtraction time from the reference time T1 as the speed change time. It is possible to adjust the timing of changing the sheet conveyance speed of the pair of registration-less rollers 7*b* so that the timing at which the sheet reaches the image formation position (secondary transfer nip 5*n*) becomes constant. The deviation caused by the correction of the skew by the registration-less unit 7 can be resolved while the sheet passes through the registration-less unit 7.

When the correction is performed to move the sheet toward the downstream side in the sheet conveyance direction, the engine control unit 9 increases the addition time as the first deviation amount D1 increases. When the correction is performed to move the sheet toward the upstream side in the sheet conveyance direction, the engine control unit 9 increases the subtraction time as the first deviation amount D1 increases. When the skew is corrected so as to travel in the conveyance direction, it is possible to delay the start of conveyance at the second speed. When the skew is corrected so that the sheet returns in the conveyance direction, it is possible to accelerate the start of conveyance at the second speed.

The engine control unit 9 obtains the first deviation amount D1 by the calculation of A×B. A is the distance from the center of the sheet to the fulcrum. B is Tan θ. The engine control unit 9 sets the time obtained by dividing the first deviation amount D1 by the first speed as the addition time or the subtraction time. The first deviation amount D1 can be determined by using the center of the sheet as a reference. Regardless of the presence or absence of skew, it is possible to determine the addition time and the subtraction time so that the time from the recognition that the sheet has arrived until the sheet reaches the image formation position (secondary transfer nip 5*n*) is the same for all sheets based on the line sensor 60.

The line sensor 60 includes the plurality of blocks. The engine control unit 9 recognizes that the sheet has reached the line sensor 60, based on the analog image signal A1 output by the central reading block among the plurality of blocks. When the level of the analog image signal A1 of each of the predetermined ratio or more of the pixels in the central reading block reaches the level indicating that the sheet has been read, the engine control unit 9 recognizes that the sheet has reached the line sensor 60. The central reading block is a block including the central reading pixel that reads the center of the sheet conveyance path in the main scanning direction. The time at which the predetermined ratio or more of the pixels read the sheet can be set as the time when the sheet has reached the line sensor 60.

The engine control unit 9 obtains the second deviation amount D2 based on the deviation of the time of the recognition that the sheet has arrived due to the skew, based on the analog image signal A1 output by the central reading block. The engine control unit 9 obtains the correction time based on the second deviation amount D2. The engine control unit 9 corrects the speed change time by adding the correction time to the determined speed change time. Each pixel in the line sensor 60 is arranged in the main scanning direction (the direction perpendicular to the sheet conveyance direction). When the sheet is not inclined, all the pixels read the sheet at the same time when the sheet arrives. When the sheet is inclined, a part of the pixels initially reads the sheet, and as the sheet conveyance progresses, the number of pixels which have read the sheet increases. As a result, when the sheet is inclined, it may be recognized that the sheet has reached the line sensor 60 after the sheet has further advanced, as compared with the case where the sheet is not inclined. The deviation of the time of the recognition may appear as the deviation of the printing position of an image. Even if there is a deviation in the recognition time, it is possible to correct the time point for changing the sheet conveyance speed, so as to fix, to be constant, the time from when the sensor recognizes that the sheet has arrived until the sheet reaches the position where an image is placed on the sheet. The timing when the sheet reaches the position at which an image is placed on the sheet can be made constant, regardless of the presence or absence of the inclination. It is possible to prevent the variations in the printing position of an image in the sheet.

When a corner on one side of the sheet in the main scanning direction is inclined in a direction protruding toward the downstream side in the sheet conveyance direction, the engine control unit 9 obtains the second deviation amount D2 by the calculation of C×D. C is the distance from the first vertex pixel to the central reading pixel. D is Tan θ. The first vertex pixel is a pixel closest to the central reading pixel among pixels each having a level representing that the level of the analog image signal A1 indicates that the sheet has not been read at the time of the recognition that the sheet has arrived. When a corner on the other side of the sheet in the main scanning direction is inclined in the direction protruding toward the downstream side in the sheet conveyance direction, the engine control unit 9 obtains the second deviation amount D2 by the calculation of E×F. E is the distance from the second vertex pixel to the central reading pixel. F is Tan θ. The second vertex pixel is a pixel closest to the central reading pixel among pixels each having a level representing that the level of the analog image signal A1 indicates that the sheet has been read at the time of the recognition that the sheet has arrived. The second deviation amount D2 can be accurately obtained in accordance with the direction of the inclination of the sheet. The speed change time can be corrected according to the inclination direction of the sheet.

The image forming device (the multifunction peripheral 100) includes the binarization circuit 8 and the filter circuit 8*a*. The binarization circuit 8 binarizes the analog image signal A1 of each pixel output by the central reading block. When the output of the binarization circuit 8 is input, and the predetermined ratio or more of the pixels in the central reading block read the sheet, the filter circuit 8*a* outputs the High level. When the output signal C1 of the filter circuit 8*a* becomes the High level, the engine control unit 9 recognizes that the sheet has reached the line sensor 60. When the predetermined number of pixels or more read the skew sheet, it is possible to determine (recognize) that the sheet has reached.

Although the embodiments of the present disclosure have been described above, the scope of the present disclosure is not limited thereto, and various modifications can be made without departing from the spirit of the disclosure. For example, the correction based on the second deviation amount D2 may not be performed. In this case, the engine control unit 9 does not execute the flowchart of FIG. 17.

The present disclosure can be used in an image forming device including a reading unit for reading a conveyance sheet.

What is claimed is:

1. An image forming device, comprising:

an image forming unit configured to form an image on a sheet to be conveyed;

a reading unit which is provided on an upstream side of the image forming unit in a sheet conveyance direction, comprises a line sensor provided so that pixels are arranged in a main scanning direction, and reads the sheet to be conveyed;

a registration-less unit disposed on an upstream side of the image forming unit in the sheet conveyance direction and on a downstream side of the reading unit in the sheet conveyance direction; and an engine control unit configured to recognize that the sheet reaches the line sensor and an inclination angle of the sheet to be conveyed, based on an analog image signal output from the line sensor, so as to control a sheet conveyance speed, wherein the registration-less unit comprises:

a pair of registration-less rollers configured to feed the sheet toward the image forming unit;

a registration-less motor configured to rotate the pair of registration-less rollers;

a case configured to accommodate the pair of registration-less rollers and comprise a fulcrum provided on one end side in the main scanning direction; and a moving mechanism configured to move the other end side of the case in the sheet conveyance direction around the fulcrum, wherein the engine control unit is configured to:

move the other end side of the case to the moving mechanism to correct skew of the sheet when the sheet enters a nip of the pair of registration-less rollers;

obtain a first deviation amount which is a deviation amount of a position of the sheet based on the correction;

rotate the pair of registration-less rollers such that the sheet conveyance speed becomes a first speed at a time when the downstream end side of the sheet in the sheet conveyance direction reaches the registration-less unit;

rotate the pair of registration-less rollers such that the sheet conveyance speed becomes a second speed after the sheet enters the nip of the pair of registration-less rollers; and adjust the timing of changing from the first speed to the second speed based on the first deviation amount.

2. The image forming device according to claim 1, wherein the second speed is faster than the first speed, and wherein the engine control unit is configured to:

change from the first speed to the second speed when a speed change time has elapsed since the recognition that the sheet reaches the line sensor;

set a predetermined reference time as the speed change time when the skew of the sheet is not corrected;

set a time obtained by adding an addition time to the reference time as the speed change time when correction for moving the sheet toward the downstream side in the sheet conveyance direction is performed; and set a time obtained by subtracting a subtraction time from the reference time as the speed change time when correction for moving the sheet toward the upstream side in the sheet conveyance direction is performed.

3. The image forming device according to claim 2, wherein the engine control unit is configured to:

increase the addition time as the first deviation amount is larger, when the correction for moving the sheet toward the downstream side in the sheet conveyance direction is performed; and increase the subtraction time as the first deviation amount is larger, when the correction for moving the sheet toward the upstream side in the sheet conveyance direction is performed.

4. The image forming device according to claim 2, wherein the inclination angle is 0, wherein the engine control unit obtains the first deviation amount by calculation of A×B, wherein A is a distance from a center of the sheet to the fulcrum, wherein B is Tan θ, and wherein the engine control unit sets a time obtained by dividing the first deviation amount by the first speed as the addition time or the subtraction time.

5. The image forming device according to claim 1, wherein the line sensor comprises a plurality of blocks, wherein the engine control unit is configured to:

recognize that the sheet has reached the line sensor based on the analog image signal output by a central reading block of the plurality of blocks; and recognize that the sheet has reached the line sensor when a level of the analog image signal of each of a predetermined ratio or more of pixels in the central reading block becomes a level indicating that the sheet has been read, wherein the central reading block is a block comprising a central reading pixel that reads a center of a sheet conveyance path in the main scanning direction.

6. The image forming device according to claim 5, wherein the engine control unit is configured to:

obtain a second deviation amount based on a deviation, due to skew, of the time of recognizing that the sheet has arrived, based on the analog image signal output by the central reading block;

obtain a correction time based on the second deviation amount; and correct the speed change time by adding the correction time to the determined speed change time.

7. The image forming device according to claim 6, wherein:

when a corner on one side of the sheet in the main scanning direction is inclined in a direction protruding toward the downstream side in the sheet conveyance direction;

the engine control unit obtains the second deviation amount by calculation of C×D;

C is a distance from a first vertex pixel to the central reading pixel;

D is Tan θ;

θ is the inclination angle;

the first vertex pixel is a pixel closest to the central reading pixel among pixels each having a level representing that the level of the analog image signal indicates that no sheet has been read at the time of recognizing that the sheet has arrived;

when a corner on the other side of the sheet in the main scanning direction is inclined in a direction protruding toward the downstream side in the sheet conveyance direction;

the engine control unit obtains the second deviation amount by calculation of E×F;

E is a distance from a second vertex pixel to the central reading pixel;

F is Tan θ;

θ is the inclination angle; and the second vertex pixel is a pixel closest to the central reading pixel among pixels each having a level representing that the level of the analog image signal indicates that a sheet has been read at the time of recognizing that the sheet has arrived.

8. The image forming device according to claim 5, the image forming device further comprising:

a binarization circuit configured to binarize the analog image signal of each pixel output by the central reading block; and a filter circuit configured to receive an output of the binarization circuit, and output a high level when a predetermined ratio or more of pixels in the central reading block read a sheet, and wherein when the output signal of the filter circuit becomes the high level, the engine control unit recognizes that the sheet has reached the line sensor.

* * * * *